US012662773B2

(12) United States Patent
Ye et al.

(10) Patent No.: US 12,662,773 B2
(45) Date of Patent: Jun. 23, 2026

(54) IRONING MODULE INCLUDING STEAM IRON AND LAUNDRY TREATING APPARATUS INCLUDING THE SAME

(71) Applicant: LG Electronics Inc., Seoul (KR)

(72) Inventors: Sungmin Ye, Seoul (KR); Sungho Song, Seoul (KR); Jaemyoung Lee, Seoul (KR); Bokyong Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/808,721

(22) Filed: Aug. 19, 2024

(65) Prior Publication Data

US 2025/0059700 A1 Feb. 20, 2025

(30) Foreign Application Priority Data

Aug. 18, 2023 (KR) ..... 10-2023-0108130
Aug. 31, 2023 (KR) ..... 10-2023-0115472

(51) Int. Cl.

*D06F 75/12* (2006.01)
*D06F 75/20* (2006.01)
*D06F 75/24* (2006.01)
*D06F 75/30* (2006.01)

(52) U.S. Cl.

CPC ..... *D06F 75/12* (2013.01); *D06F 75/20* (2013.01); *D06F 75/24* (2013.01); *D06F 75/30* (2013.01)

(58) Field of Classification Search

CPC ..... D06F 75/12; D06F 75/10; D06F 75/20; D06F 75/24; D06F 75/30

See application file for complete search history.

(56) References Cited

U.S. PATENT DOCUMENTS

2010/0166396 A1* 7/2010 Xu ..... D06F 73/00 392/394

FOREIGN PATENT DOCUMENTS

| | | | | |
|---|---|---|---|---|
| JP | 2008503304 A | * | 2/2008 | ..... D06F 75/26 |
| JP | 3187957 U | | 12/2013 | |
| JP | 2020-500666 A | | 1/2020 | |
| KR | 10-2008-0001854 A | | 1/2008 | |
| KR | 10-1156762 B1 | | 6/2012 | |
| KR | 10-1181352 B1 | | 9/2012 | |
| KR | 10-1597108 B1 | | 2/2016 | |
| KR | 10-1636847 B1 | | 7/2016 | |
| KR | 10-2020-0141302 A | | 12/2020 | |

OTHER PUBLICATIONS

International Search Report and Written Opinion in International Appln. No. PCT/KR2024/012193, mailed on Dec. 6, 2024, 10 pages.

Notice of Allowance in Korean Appln. No. 10-2023-0115472, mailed on Jan. 28, 2026, 3 pages (with English translation).

* cited by examiner

*Primary Examiner* — Nathan E Durham

(74) *Attorney, Agent, or Firm* — Fish & Richardson P.C.

(57) ABSTRACT

The present disclosure relates to an ironing module including a water supply tank that stores water therein, a steam generator that receives water from the water supply tank and heats water, a cable that transmits at least one of water and steam heated by the steam generator, and a steam iron connected to a distal end of the cable to spray steam to the outside, and preventing condensate from being discharged to the outside of the steam iron.

15 Claims, 28 Drawing Sheets

Section Y-Y'

Section Z-Z'

IRONING MODULE INCLUDING STEAM IRON AND LAUNDRY TREATING APPARATUS INCLUDING THE SAME

CROSS-REFERENCE TO RELATED APPLICATIONS

This application claims the benefit of Korean Patent Applications Nos. 10-2023-0108130, filed on Aug. 18, 2023, and 10-2023-0115472, filed on Aug. 31, 2023. The disclosures of the prior applications are incorporated by reference in their entirety.

TECHNICAL FIELD

The present disclosure relates to an ironing module including a steam iron that may spray steam onto laundry, and a laundry treating apparatus including the same.

BACKGROUND

In general, an ironing module including a steam iron is different from a general iron in that a steam generator that generates steam and the steam iron that discharges steam are disposed to be spaced apart from each other and connected to each other via a cable.

Because such steam iron is disposed to be separated from the steam generator, there is an advantage of being lighter than the general iron in which the steam generator and a heating plate are integrated. Further, because such steam iron is able to spray steam while freely moving in three-dimensional directions within a range allowed by the cable without being restricted by an installation location of the steam generator, there is an effect of removing wrinkles even when laundry is hung on a clothes hanger or the like.

Therefore, various ironing modules in which the steam iron that sprays steam and the steam generator that generates steam are disposed to be separated from each other have recently appeared (see US Patent Application Publication No. 2008/0040953).

However, because such steam iron is disposed separately from the steam generator, even when high-temperature steam is generated in the steam generator, steam condenses into water during a process of being delivered to the steam iron.

In addition, even when steam is delivered to the steam iron, steam condenses into water during a process of passing through the steam iron and being discharged to the outside.

In this case, when using the existing ironing modules, there is an inconvenience that the laundry gets wet and becomes unsuitable for immediate wear or the laundry is not able to be immediately stored in a closet or the like until it is dried.

In addition, in a case of silk or cashmere, which is vulnerable to moisture, the fabric is damaged during a process of wrinkle removal or deodorization using the steam iron.

In addition, because water discharged from the steam iron is generated as high-temperature steam condenses, it may cause burns when exposed to a user's body.

Furthermore, there is also a frequent issue where water condensed inside the steam iron or in the cable blocks a flow channel through which steam passes and an intended spray amount of steam is not secured.

SUMMARY

The present disclosure is to provide an ironing module in which a steam iron that sprays steam and a steam generator that supplies steam to the steam iron are spaced apart from each other and connected to each other via a cable, preventing water from leaking out of the steam iron.

The present disclosure is to provide an ironing module that may reheat at least one of water and steam supplied to a steam iron and change states of both water and steam into a steam state.

The present disclosure is to provide a laundry treating apparatus that may reheat water condensed in a steam iron and change a state thereof into a steam state.

The present disclosure is to provide an ironing module that prevents water from being discharged to the outside even when it is condensed in a steam iron.

To solve the above-mentioned problems, the present disclosure provides an ironing module including a water supply tank that stores water therein, a steam generator that receives water from the water supply tank and heats water, a cable that transmits at least one of water and steam heated by the steam generator, and a steam iron connected to a distal end of the cable to spray steam to the outside.

The steam iron includes a chamber that receives water and steam from the cable, reheats water and steam, and sprays water and steam.

The chamber includes a housing providing a heating space to accommodates at least one of water and steam supplied from the cable, a heater that is coupled to the housing and heats the housing, an inlet connected to the cable by extending through one surface of the housing, a sprayer that discharges steam to the outside of the housing by extending through an opposite surface to the one surface of the housing, a blocking partition wall dividing inside of the housing into a heating chamber in communication with the inlet and a spray chamber in communication with the sprayer, and a guide nozzle allowing at least one of water and steam that have reached the blocking partition wall from the heating chamber to the spray chamber.

The guide nozzle faces an inner wall of the opposite surface of the housing and supplies water and steam toward the inner wall.

The guide nozzle may be disposed such that at least a partial area thereof is blocked from facing the sprayer.

The chamber may further include a cover coupled to an upper portion of the housing and shielding the heating space. The sprayer may be disposed at a vertical level lower than a vertical level of the guide nozzle.

The chamber may further include a collecting portion positioned at a vertical level lower than the vertical level of the sprayer in the spray chamber to provide a collection space where water is stored and heated.

The guide nozzle may be defined as at least one area of an upper end of the blocking partition wall is stepped or recessed so as to be spaced apart from the cover.

The guide nozzle may have a lower end positioned closer to the cover than to a lower end of the blocking partition wall.

The guide nozzle may be defined by cutting a partial area of the blocking partition wall or extending through the blocking partition wall.

A lower end of the guide nozzle may be positioned closer to a lower end of the blocking partition wall than to the cover.

The chamber may further include a separating partition wall disposed in the spray chamber so as to face the guide nozzle.

The separating partition wall may include a steam guide hole allowing at least one of water and steam that have passed through the guide nozzle to flow toward the sprayer.

The steam guide hole may be defined such that at least a partial area thereof is blocked from facing the guide nozzle.

The steam guide hole may be defined with a width or an area size smaller than a width or an area size of the guide nozzle.

The collecting portion may be positioned between the separating partition wall and the sprayer.

The chamber may further include at least one guiding partition wall disposed in the heating chamber to form a flow channel to guide water and steam introduced into the inlet to the blocking partition wall, and a protrusion protruding from the guiding partition wall.

The guiding partition wall may have an area spanning between the inlet and the sprayer longer than an area from the inlet toward the sprayer.

The present disclosure may prevent water from leaking out of the steam iron in the ironing module in which the steam iron that sprays steam and the steam generator that supplies steam to the steam iron are spaced apart from each other and connected to each other via the cable.

The present disclosure may reheat at least one of water and steam supplied to the steam iron and change the states of both water and steam into the steam state.

The present disclosure may reheat water condensed in the steam iron and change the state thereof into the steam state.

The present disclosure prevents water from being discharged to the outside even when it is condensed in the steam iron.

DETAILED DESCRIPTION

Figure 1:
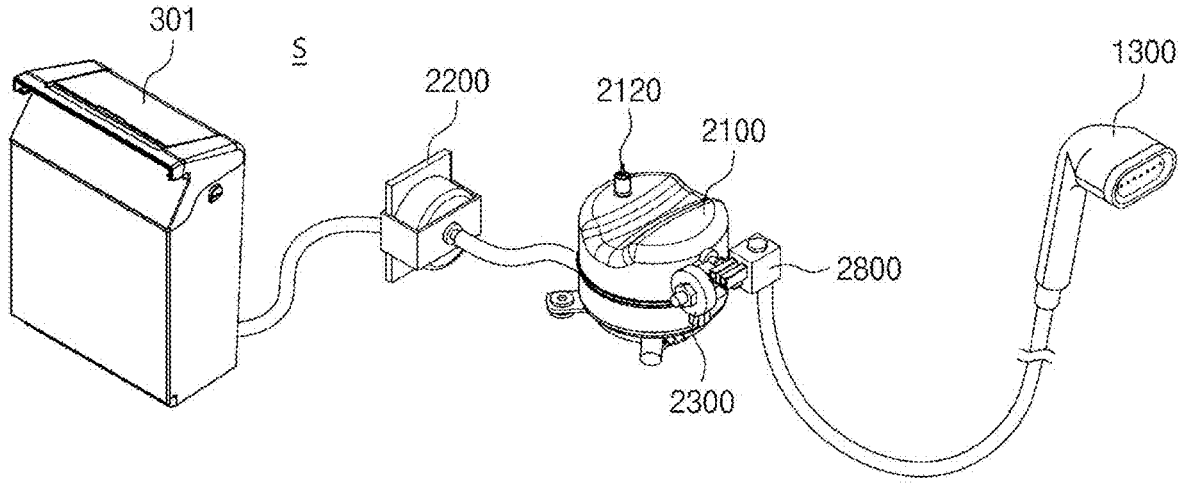
FIG. 1 shows an ironing module S of the present disclosure.

Hereinafter, embodiments disclosed herein will be described in detail with reference to the attached drawings. In the present document, identical or similar components are assigned identical or similar reference numerals even in different embodiments, and descriptions thereof are replaced with the first description. A singular expression used herein includes a plural expression unless the context clearly indicates otherwise. In addition, when describing the embodiments disclosed herein, when it is determined that a detailed description of a related known technology may obscure the gist of the embodiments disclosed herein, the detailed description thereof will be omitted. In addition, it should be noted that the attached drawings are only intended to facilitate easy understanding of the embodiments disclosed herein, and the technical ideas disclosed herein should not be construed as being limited by the attached drawings. In the present document, an X-axis means a front and rear direction of a laundry treating apparatus, a Y-axis means a width direction of the laundry treating apparatus, and a Z-axis means a height direction of the laundry treating apparatus.

FIG. 1 shows an ironing module S of the present disclosure.

The ironing module S of the present disclosure may include a steam generator 2100 that receives water and heats water into steam, a cable 1400 that receives and transmits steam generated in the steam generator 2100, and a steam iron 1300 that is coupled to the cable 1400 and sprays steam onto laundry or the like.

The ironing module S of the present disclosure may further include a water supply tank 301 that stores water that is to be supplied to the steam generator 2100, and a water supply pipe that connects the water supply tank 301 with the steam generator 2100.

The cable 1400 may transmit at least one of steam and water to the steam iron 1300, and may also include a built-in control line or the like that is in communication with the steam iron 1300 or supplies power to the steam iron 1300.

The ironing module S of the present disclosure may be constructed as an independent apparatus. In this case, the ironing module S may be portable.

In one example, the ironing module S of the present disclosure may also be constructed as a part of an ironing system or a laundry treating apparatus, such as a laundry manager.

In any case, the ironing module S of the present disclosure may be in any structure as long as it may heat water and spray steam to the laundry with the steam iron 1300.

The steam generator 2100 may be connected to the separate water supply tank 301 to receive water.

When the ironing module S of the present disclosure is equipped as the independent apparatus, the ironing module S of the present disclosure may further include the water supply tank 301, and a water supply structure 2500 that connects the water supply tank 301 with the steam generator 2100.

However, when the ironing module S of the present disclosure is equipped as the part of the laundry treating apparatus, the water supply tank 301 and the water supply structure 2500 of the corresponding laundry treating apparatus may be shared.

The water supply structure 2500 may compress water supplied from the water supply tank 301 at a high pressure and supply compressed water to the steam generator 2100.

Accordingly, even when the steam generator 2100 heats water at a pressure equal to or higher than 1 atm to generate steam, water may be continuously supplied into the steam generator 2100.

The steam iron 1300 may be divided into a portion that a user may grip and a portion that sprays steam supplied from the steam generator 2100 onto the laundry at a distal end.

The portion that the user may grip is heat-insulated with plastic to prevent the user from getting burned, and the portion where steam is sprayed is made of metal to effectively transfer heat to the laundry.

The steam iron 1300 may be equipped with a separate input unit that may adjust operation or stop of the steam generator 2100, an amount of steam generated from the steam generator 2100, a temperature of steam, and the like.

The ironing module S of the present disclosure may further include a drainage tank 302 that may recover water remaining unheated in the steam generator 2100, water condensed from steam, or water condensed in the cable 1400, and a drainage structure 2600 that connects the steam generator 2100 with the drainage tank 302.

When the ironing module S of the present disclosure is equipped as the part of the laundry treating apparatus or the like, the drainage structure 2600 and the drainage tank 302 may be shared with the laundry treating apparatus.

The steam generator 2100 may further include a steam body 2110 that provides a storage space for storing therein water received from the water supply tank 301, a heater 2130 that heats water in the steam body 2110 or the storage space, an entrance 2140 that supplies water to the steam body 2110, an exit 2150 that discharges at least one of water and steam heated in the steam body 2110, a temperature sensor 2120 that is coupled to the steam body 2110 and senses a temperature inside the storage space or the steam body 2110, and a steam valve 2310 that opens and closes the exit 2150.

Accordingly, the ironing module S of the present disclosure may induce steam of an intended temperature to be discharged from the steam generator 2100 via control of the steam valve 2310 and the heater 2130.

In addition, the steam generator 2100 may further include a pressure sensor 2300 that senses a pressure of the storage space or the exit 2150.

Accordingly, the ironing module S of the present disclosure may induce steam of an intended pressure to be discharged from the steam generator 2100.

As a result, the ironing module S of the present disclosure may control all of the temperature, the pressure, and a spray amount of steam transmitted to the cable 1400 via the temperature sensor 2120, the pressure sensor 2300, and an opening and closing timing of the steam valve 2310.

Figure 2A:
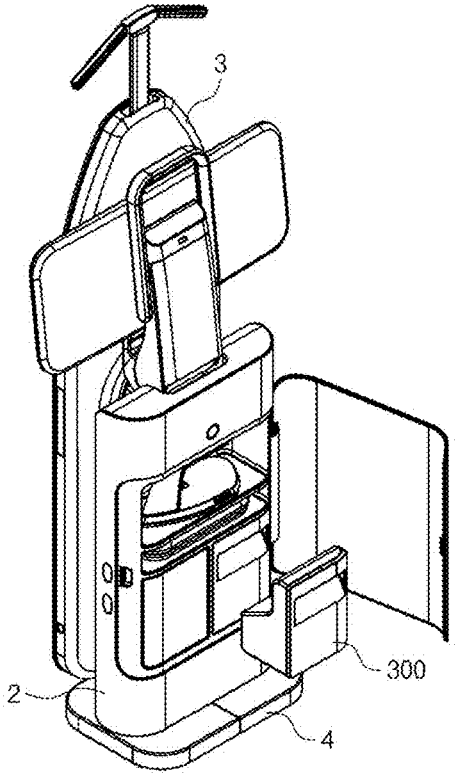
FIGS. 2A and 2B show an embodiment in which the ironing module S of the present disclosure is installed in an ironing system.
Figure 2B:
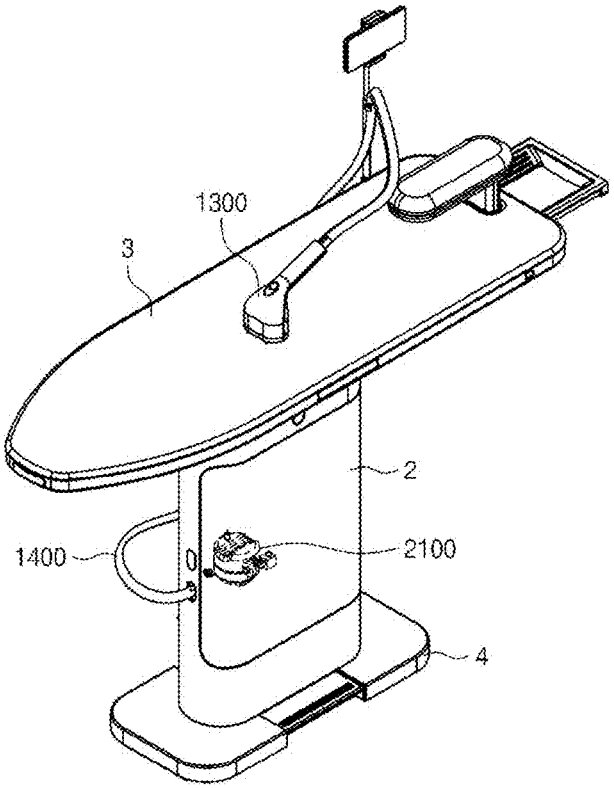

FIGS. 2A and 2B show an embodiment in which the ironing module S of the present disclosure is installed in an ironing system.

The ironing system of the present disclosure may include an ironing board 3 having a pressing surface on which the laundry may be pressed, a support column 2 connected to the ironing board to support the ironing board, and a ground contact portion 4 disposed beneath the support column 2 to secure the support column to the ground.

The ironing board 3 may have a width greater than a length. For example, the ironing board 3 may be formed in a shape such as a skateboard or a surfboard.

The ironing board 3 may be seated on an upper end of the support column 2, may be rotatable at the upper end of the support column 2, and may be rotatable upward or laterally relative to the support column 2 so as to be disposed on a side surface of the support column 2.

The laundry may be disposed on a top surface of the ironing board 3 and may be pressed by an iron.

The support column 2 may have a height greater than a width or a thickness.

The iron may be detachably disposed inside the support column 2.

In addition, the ironing module S may be installed inside the support column 2, and the steam iron 1300 may also be detachably disposed.

The steam generator 2100 may be fixedly installed inside the support column 2, and the water supply tank 301 may also be installed. The water supply tank 301 may also be detachably disposed, and the steam generator 2100 may supply steam not only to the steam iron 1300 but also to the iron.

The exit 2150 of the steam generator 2100 may be in communication with an inner surface of the support column 2, and the cable 1400 may have one end detachably coupled to the side surface of the support column 2 and the other end detachably coupled to the steam iron 1300.

Figure 3:
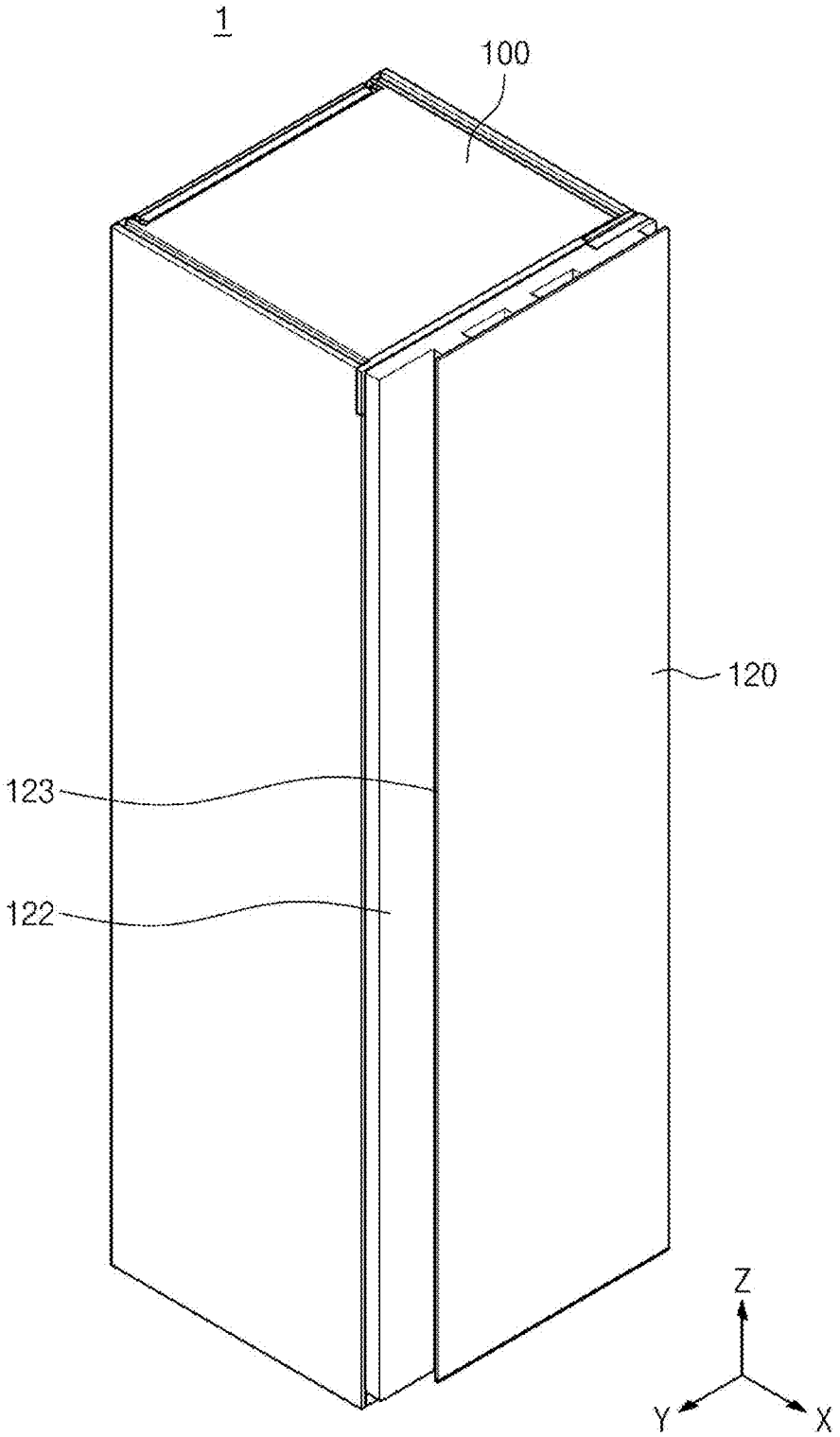
FIG. 3 shows an embodiment in which the ironing module S of the present disclosure is installed in a laundry treating apparatus equipped as a laundry manager.

FIG. 3 shows an embodiment in which the ironing module S of the present disclosure is installed in a laundry treating apparatus equipped as a laundry manager.

The ironing module S of the present disclosure may be installed in a machine room located inside a door or in a lower portion of the laundry treating apparatus.

Specifically, the laundry treating apparatus may include a cabinet 100 forming an outer appearance, and a door 120 pivotably coupled to the cabinet 100.

The door 120 may include a main body 121 forming a front surface of the cabinet 100, and an installation body 122 extending from one side of the main body 121 and where a display for displaying information of the laundry treating apparatus may be installed.

The cabinet 100 may be constructed such that a height is greater than a width in a left and right direction and a thickness in a front and rear direction. Accordingly, in the laundry treating apparatus, even long laundry may be hung inside the cabinet 100 without being folded.

The installation body 122 may be extended from the main body 121 while forming a step rearward of the cabinet 100.

The installation body 122 may be made of a material or may have a color different from that of the main body 121. In addition, the installation body 122 may be made of a translucent material through which light emitted from the display may be transmitted.

A handle 123 may be disposed in an area where the installation body 122 and the main body 121 are stepped.

The handle 123 may be disposed on one surface of the main body 121 to extend forward of the installation body 122 in parallel with the main body 121. As a result, the handle 123 may be disposed to at least partly overlap the installation body 122 in the front and rear direction, and may define a space that the user may grip.

The cabinet 100 and the door 120 may be made of a metal material.

Figure 4:
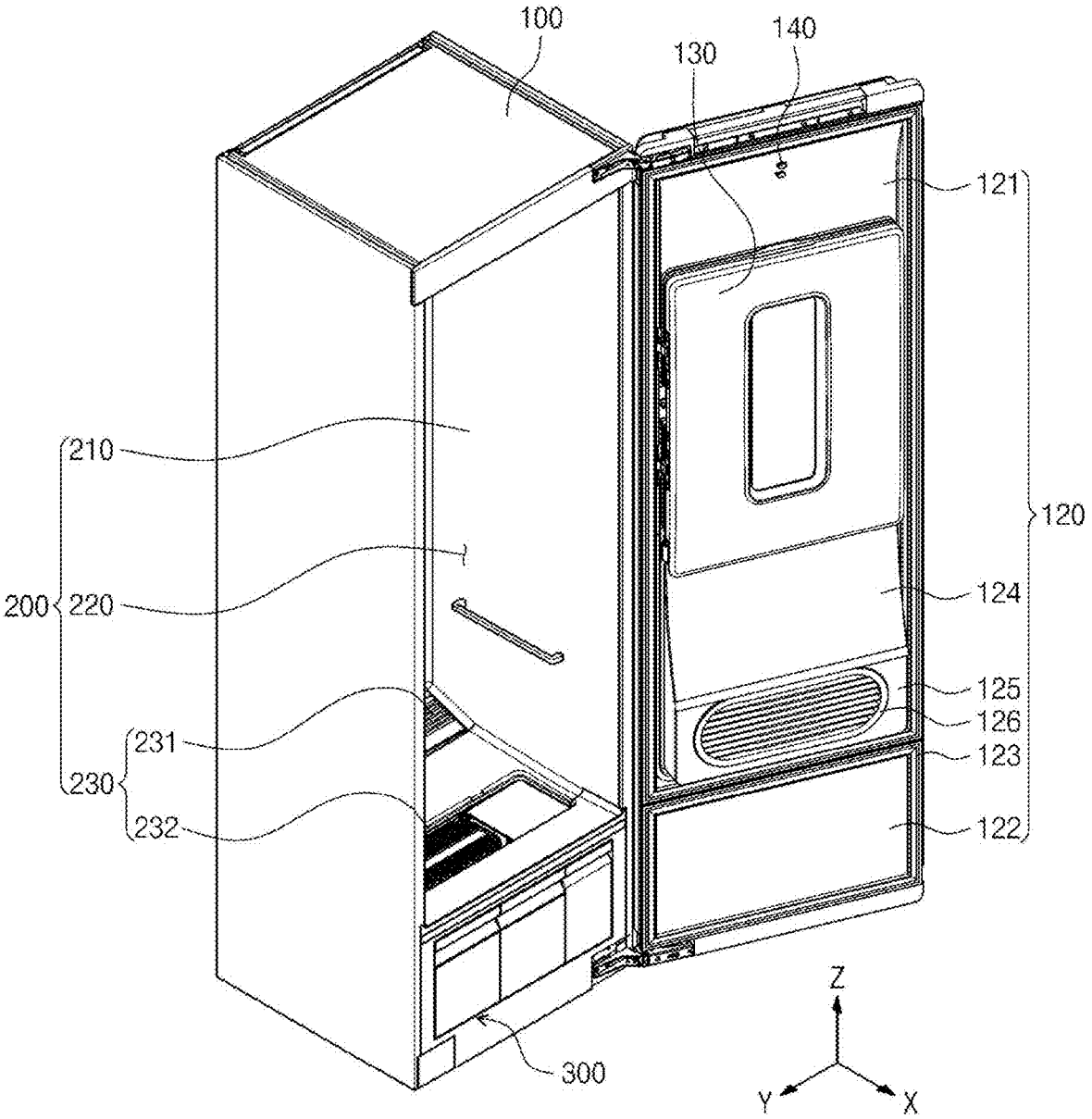
FIG. 4 shows interior of a cabinet of a laundry treating apparatus of the present disclosure.

FIG. 4 shows interior of a cabinet of a laundry treating apparatus of the present disclosure.

An inner casing 200 that has an accommodating space 220 for accommodating the laundry defined therein and defines an opening 210 in a front side through which the laundry is introduced may be disposed inside the cabinet 100.

The inner casing 200, which has a rectangular parallelepiped shape with an open front surface, may have a height smaller than that of the cabinet 100. As a result, an area in which a machine room 300 to be described below may be installed may be secured in the lower portion of the cabinet 100.

The inner casing 200 may have the height greater than a width and a thickness. As a result, the laundry may be hung inside the accommodating space 220 without being folded or wrinkled.

The inner casing 200 may be made of a plastic resin material, and may be made of a reinforced plastic resin material that does not deform even when exposed to air at a temperature higher than a room temperature or heated air (hereinafter, hot air) and steam or moisture.

A hanger where the laundry may be hung in the accommodating space 220 may be disposed in an upper portion of an inner surface of the inner casing 200. The hanger may be formed in a clothes hanger shape and may be fixed to a top surface of the inner casing 200. Because of the hanger, the laundry may be disposed in the unfolded state and in a state of being suspended in air within the accommodating space 220.

A plurality of the hangers may be disposed along a width direction of the inner casing 200. As a result, a plurality of laundry pieces may be hung, spaced apart from each other within the inner casing 200.

The hanger may be constructed as a moving hanger that reciprocates or rotates in a reciprocating manner in the width direction within the inner casing 200. The laundry treating apparatus of the present disclosure may shake the laundry inside the inner casing because of the hanger, and the laundry may be shaken inside the accommodating space 220, thereby removing foreign substances, dust, and the like, and also removing wrinkles formed on the laundry.

The laundry treating apparatus of the present disclosure may be equipped with the machine room 300 in which various apparatuses are installed, which supply high-temperature air and heated air (hereinafter, hot air) to the accommodating space 220, supply steam to the accommodating space 220, or purify or dehumidify outside air of the cabinet 100.

The machine room 300 may be disposed separately or partitioned from the inner casing 200, but may be in communication with the accommodating space 220.

The machine room 300 may be disposed under the inner casing 200. Accordingly, when hot air and steam having a low specific gravity are supplied to the inner casing 200, hot air and steam may naturally rise in the accommodating space 220 and be supplied to the hung laundry.

The inner casing 200 may be partitioned and separated from the machine room 300 via a bottom surface 230. However, a plurality of through-holes may be defined in the bottom surface 230 to be in communication with the machine room 300.

To this end, the inner casing 200 may have a plurality of through-holes 230 that extend through one surface thereof and are in communication with the machine room 300.

Via the through-holes 230, air in the accommodating space 220 may be supplied to the machine room 300 and at least one of hot air and steam generated in the machine room 300 may be supplied to the accommodating space 220.

The through-holes 230 may include an inflow hole 232 extending through the bottom surface 230 of the inner casing 200 and allowing air inside the inner casing 200 to be discharged or sucked into the machine room 300, and an exhaust hole 231 extending through the bottom surface of the inner casing 200 and allowing hot air generated in the machine room 300 to be discharged.

The exhaust hole 231 may be defined to be biased rearward in the bottom surface of the inner casing 200. In addition, the inflow hole 232 may be defined to be biased forward in the bottom surface of the inner casing 200. As a result, a separation spacing between the inflow hole 232 and the exhaust hole 231 may be secured on the bottom surface 230 of the inner casing 200, and hot air supplied from the exhaust hole 231 may be prevented from being directly discharged to the inflow hole 232.

The through-holes 230 may further include a steam hole 233 into which steam generated in a steam supply 800 to be described below is supplied. The steam hole 233 may be defined closer to the exhaust hole 231 than to the inflow hole 232. For example, the steam hole 233 may be defined on one side of the exhaust hole 231. As a result, steam discharged from the steam hole 233 may be prevented from flowing directly into the inflow hole 232.

The door 120 may be pivotably coupled to the cabinet 100.

A height of the door 120 may correspond to the height of the cabinet 100. As a result, the door 120 may open and close the opening 210, and may also shield the machine room 300.

When the door 120 is closed, the opening 210 and the machine room 300 may be prevented from being exposed forward.

The door 120 may include a door body 121 forming a main body and a sealing member 123 coupled to an inner surface of the door body 121 to seal the opening 210.

The sealing member 123 may be disposed in an area facing a periphery of the opening 210 on the inner surface of the door body 121 to seal the opening 210.

In one example, the door body 121 may include a protective panel 122 that shields the machine room 300 and protects the machine room 300 under the sealing member 123 that seals the opening 210.

The sealing member 123 may extend downward of the opening 210 to also seal a front periphery of the machine room 300.

The door 120 may include a protruding portion 125 that protrudes from the inner surface of the door body 121 such that at least a portion thereof may be inserted into the opening 210.

The protruding portion 125 may protrude from the door body 121 to an extent that it is disposed in front of the inflow hole 232 when the door 120 closes the opening 210.

The protruding portion 125 may have a width corresponding to a width of the opening 210. The protruding portion 125 may be disposed closer to a lower portion of the opening 210 or the bottom surface 230 of the inner casing 200 than to an upper end of the door body 121.

As a result, hot air and steam in the accommodating space 220 of the inner casing may be guided to be introduced into the inflow hole 232, and may be prevented from being discharged out of the opening 210 and being exposed to the machine room 300.

A height of the protruding portion 125 may be smaller than ⅓ of the height of the inner casing 200, and a thickness of the protruding portion 125 protruding from the door body 121 may be smaller than a spacing from a front edge of the bottom surface 230 to the inflow hole 232.

The door body 121 may further include a curved surface 124 extending toward the protruding portion 125 on the inner surface thereof. The curved surface 124 may be formed in a downwardly convex shape. The curved surface 124 may induce hot air and steam supplied to the accommodating space 220 to circulate inside the accommodating space 220.

The laundry treating apparatus of the present disclosure may include a pressurizer 130 that is pivotably coupled to the inner surface of the door body 121 to pressurize the laundry, and a fixer 140 that may hang the laundry at a vertical level higher than that of the pressurizer 130.

The pressurizer 130 may pivot in a width direction of the door 120 to pressurize the laundry hung on the fixer 140.

Accordingly, by pressing the laundry hung on the fixer 140 with the pressurizer 130, the wrinkles in the laundry may be removed, and intended creases may also be formed in the laundry.

The curved surface 124 may extend from a lower end of the pressurizer 130 to the protruding portion 125. Accordingly, when water condensed in the laundry hung on the fixer 140 flows along the pressurizer 130 or the inner surface of the door body 121, water may flow along the curved surface 124 and be guided to the bottom surface 230 and may be prevented from flowing to the opening 210 or the sealing member 123. As a result, the machine room 300 may be prevented from being contaminated with water, steam, hot air, the foreign substances, and the like.

The protruding portion 125 may have an exposed surface disposed parallel to a rear surface of the inner casing 200, and a bottom surface extending from a lower portion of the exposed surface may be disposed parallel to the bottom surface 230 of the inner casing.

The exposed surface of the protruding portion 125 may have a through-hole 126 that extends through the exposed surface to allow air to enter and exit, and may have a duct through which air may flow in a space defined by the protruding portion 125, the curved surface 124, and the door body 121.

The door body 121 may have a communication hole in communication with the duct in an area of the inner surface corresponding to the pressurizer 130.

Accordingly, hot air and steam flowing in the inner casing 200 may be introduced into the through-hole 126 and discharged via the communication hole to dry the laundry hung on the pressurizer 130 or circulate air inside the inner casing 200.

Figure 5:
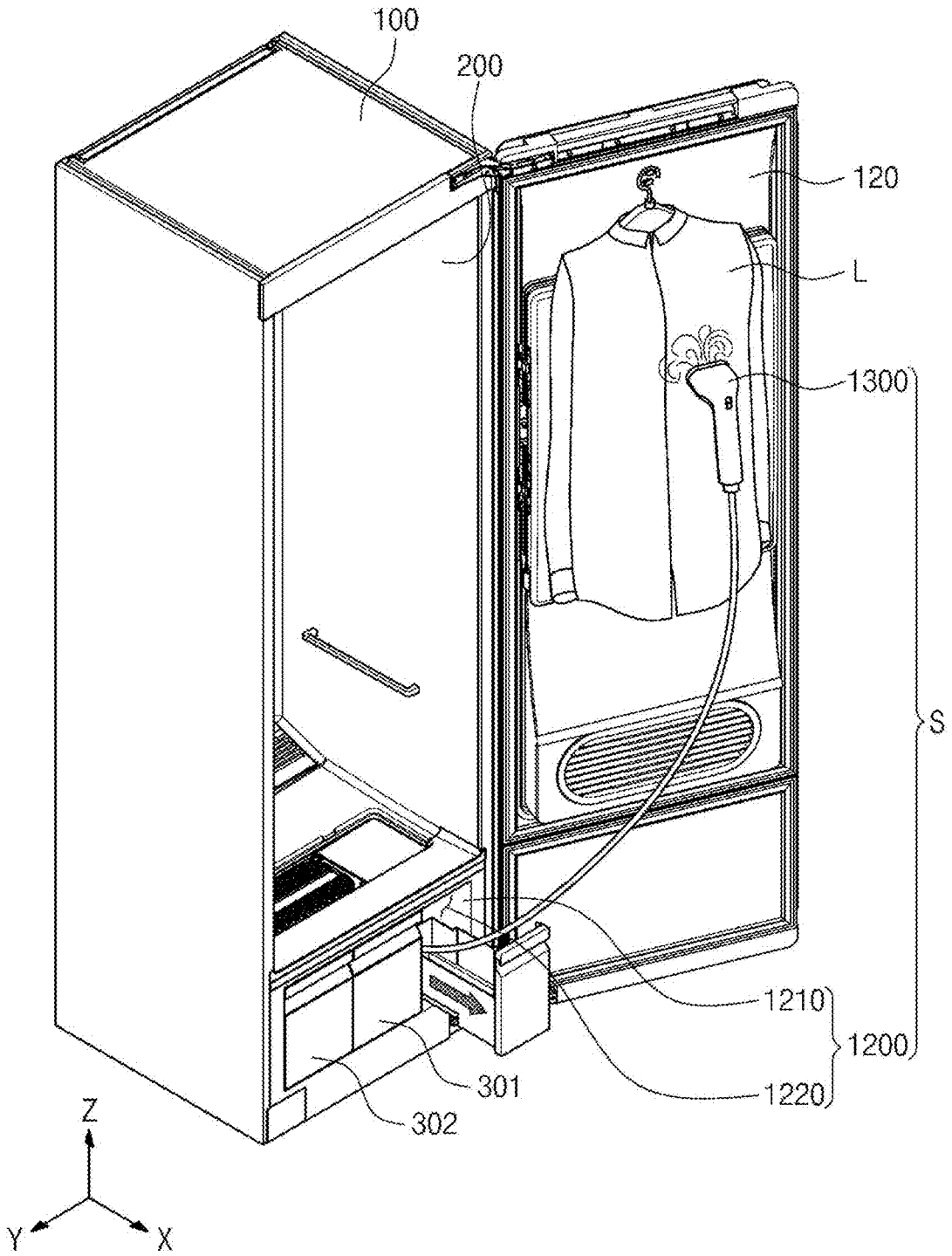
FIG. 5 shows an outer appearance of the machine room 300.

FIG. 5 shows an outer appearance of the machine room 300.

The machine room 300 supplies at least one of hot air and steam to the inner casing 200. To this end, the machine room 300 should be supplied with water necessary to generate steam and should collect steam supplied to the inner casing 200 or water condensed from the laundry.

To this end, the machine room 300 may include the water supply tank 301 that stores water to be used for steam, and the drainage tank 302 that collects water condensed inside the laundry treating apparatus.

The water supply tank 301 and the drainage tank 302 may be disposed in a front portion of the machine room 300. As a result, it may be easy to fill the water supply tank 301 with water or empty water in the drainage tank 302, and the laundry treating apparatus may be disposed without being limited by locations of a water source and a drain.

The ironing module S may be installed in the machine room.

The ironing module S may be equipped to supply heat and steam to a surface of the laundry.

The ironing module S may further include a storage box 1200 that stores the steam iron 1300 that may spray or supply at least one of heat and steam to the surface of the laundry inside the machine room 300.

The storage box 1200 may include a storage body 1210 that is mounted in the machine room 300 and provides a space in which the steam iron 1300 is stored, and an open surface 1220 defined in a front surface of the storage body 1210 and through which the steam iron 1300 is inserted and withdrawn.

The steam iron 1300 may be withdrawn from the machine room 300 while being withdrawn forward of the storage body 1210. The steam iron 1300 may reach the surface of the laundry hung on the fixer 140 or the hanger when withdrawn forward of the machine room 300.

The steam iron 1300 may transmit heat and steam to an upper end of the pressurizer 130 of the door 120, which is located upward of a midpoint in a height direction of the inner casing 200. The steam iron 1300 may be in contact with the surface of the laundry or may be disposed close to the laundry to directly spray heat and steam to the surface of the laundry.

For example, the steam iron 1300 may reach the hanger or the fixer 140. In addition, the steam iron 1300 may move to a top surface of the accommodating space 220 or an upper end of the inner surface of the door 120 when withdrawn from the storage box 1200.

The steam iron 1300 may supply heat to the surface of the laundry or may spray steam to the surface of the laundry. The steam iron 1300 may be equipped as a general steam iron or a general steamer. The steam iron 1300 may be equipped as any component as long as it satisfies a condition of removing the wrinkles that have occurred in the laundry.

Laundry L fixed to the hanger or the fixer 140 may be supported on the inner surface of the door 120 or an inner surface of the inner casing 200 and may be exposed to at least one of heat and steam supplied from the steam iron 1300. In this process, the laundry L may be refreshed or wrinkles thereof may be removed.

The ironing module S may be exposed to the front surface of the machine room 300, because the steam iron 1300 should be withdrawn from the machine room 300 to the laundry hung in the inner casing 200 or on the door 120.

For example, a front surface of the ironing module S may be disposed on one side of the water supply tank 301 or the drainage tank 302, and both side surfaces thereof may be disposed inside the machine room 300.

The water supply tank 301 and the drainage tank 302 may be shared by the ironing module S and a refreshing module T.

Figure 6:
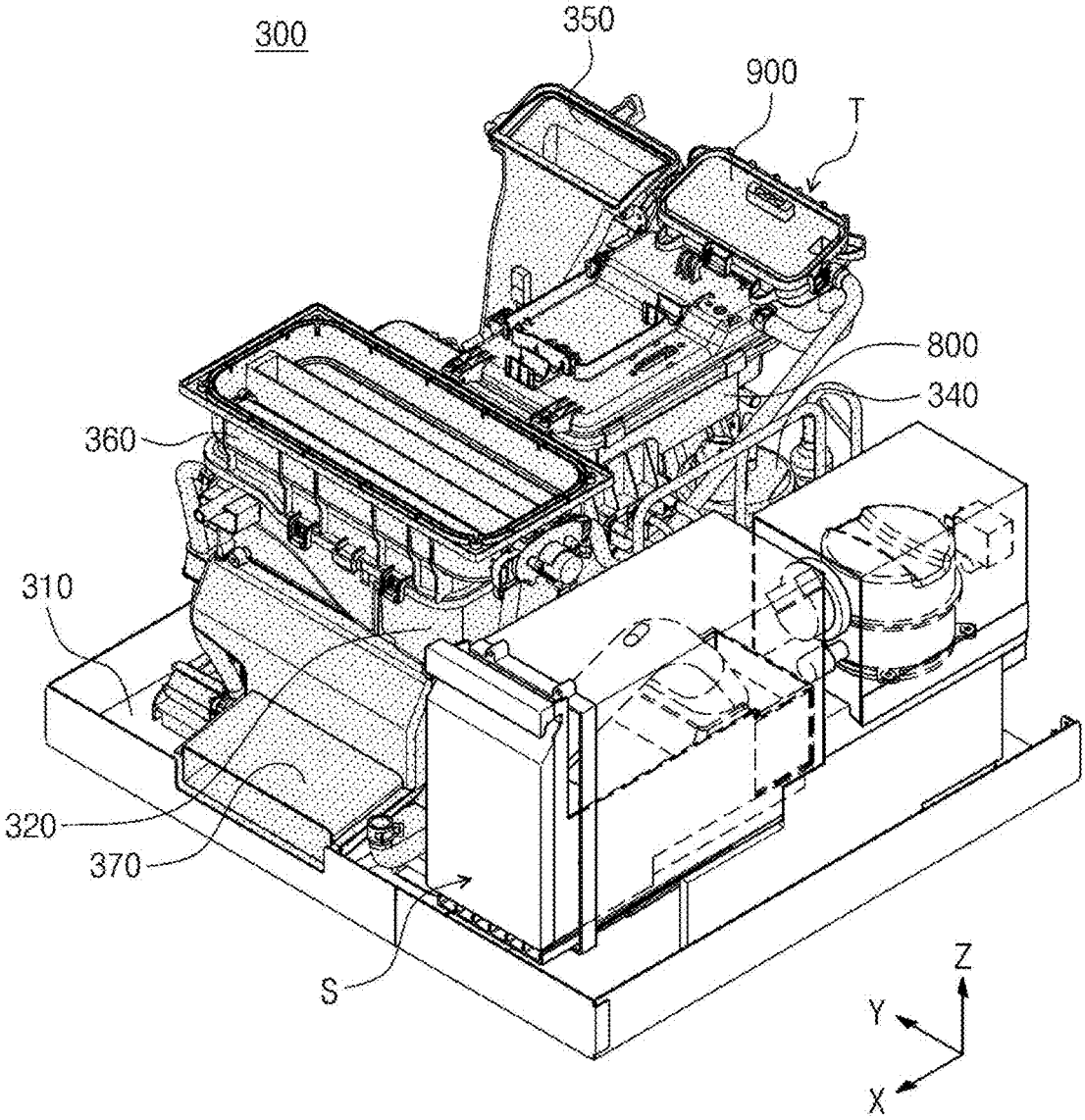
FIG. 6 shows a structure of a machine room of a laundry treating apparatus of a present disclosure.

FIG. 6 shows a structure of a machine room of a laundry treating apparatus of a present disclosure.

The machine room 300 may include therein the refreshing module T equipped as a component that may supply hot air and steam to the laundry hung in the accommodating space 220, circulate air inside the accommodating space, or circulate air outside the cabinet, and the ironing module S including the steam iron 1300.

The refreshing module T may include all apparatuses and components that may supply at least one of hot air and steam into the inner casing 200.

Specifically, the machine room 300 may include a base 310 on which a space where the various apparatuses described above may be supported or installed, a circulation duct 320 that is installed on or extended from the base 310 and provides a flow channel through which air inside the inner casing 200 or air outside the cabinet 100 flows, a blower 350 that is mounted on the circulation duct 320 and provides power to allow air to flow, a heat supply 340 that cools and heats air flowing along the circulation duct 320 to generate hot air, and the steam supply 800 that is supported on the base 310 or mounted on the circulation duct 320 and supplies steam into the inner casing 200.

The base 310 may be formed as a plate on which the various apparatuses are installed.

The circulation duct 320 may form a flow channel through which air introduced from the inner casing 200 or the outside of the cabinet 100 flows, and may be formed in a casing shape with an open top.

The heat supply 340 may include a heat exchanger disposed inside the circulation duct 320 to cool air, condense moisture, and reheat air, and a compressor disposed outside the circulation duct 320 to receive a refrigerant from the heat exchanger or supply the refrigerant.

The refreshing module may further include an outside air duct 370 that sucks outside air in front of the circulation duct 320 and guides sucked air into the circulation duct 320.

The circulation duct 320 may be in communication with the outside air duct 370 and selectively suck outside air.

The water supply tank and the drainage tank may also be included in the refreshing module T.

The water supply tank and the drainage tank may be detachably coupled to a front surface of the circulation duct 320. For example, the water supply tank 301 and the drainage tank 302 may be seated and disposed on the outdoor air duct 370.

The circulation duct 320 may be coupled to the base 310, but may be formed integrally with the base 310. For example, the base 310 and the circulation duct 320 may be simultaneously manufactured via injection molding.

The refreshing module T may include a base cover 360 disposed to be in communication with the circulation duct 320 and the inflow hole 232.

The base cover 360 may be coupled to an upper portion of the circulation duct 320 to guide air sucked in the inflow hole 232 into the circulation duct 320.

The base cover 360 may block air inside the circulation duct 320 from being discharged to the outside by shielding a top surface of the circulation duct 320. A lower portion of the base cover 360 and the top surface of the circulation duct 320 may form one surface of a flow channel of the circulation duct 320.

The base cover 360 may include an inlet 362 that allows the inflow hole 232 and the circulation duct 320 to be in communication with each other therein. The inlet 362 may be formed in a duct shape to serve as an intake duct that delivers air inside the inner casing 200 to the circulation duct 320.

The steam supply 800 may be connected to the water supply tank 301 and receive water to generate steam. The steam supply 800 may be seated and disposed on the circulation duct 320.

The steam supply 800 may be disposed at the rear of the base cover 360.

The refreshing module T may further include a steam nozzle 900 that receives steam from the steam supply 800 and supplies steam into the inner casing 200. The steam nozzle 900 may be disposed between the steam supply 800 and the steam hole 233.

Water that has not been discharged from the steam nozzle 900 to the steam hole 233 but condensed may be recovered again to the steam supply 800.

The blower 350 may allow the circulation duct 320 and the exhaust hole 231 to be in communication with each other.

The ironing module S may be disposed on a left or right side of the refreshing module T inside the machine room 300. Specifically, the ironing module S may be disposed outside the circulation duct 320. Thus, the ironing module S may not obstruct a flow of air through the circulation duct 320.

The ironing module S may be disposed at one side of the base 310 to be parallel thereto along a length direction of the circulation duct 320.

Figure 7:
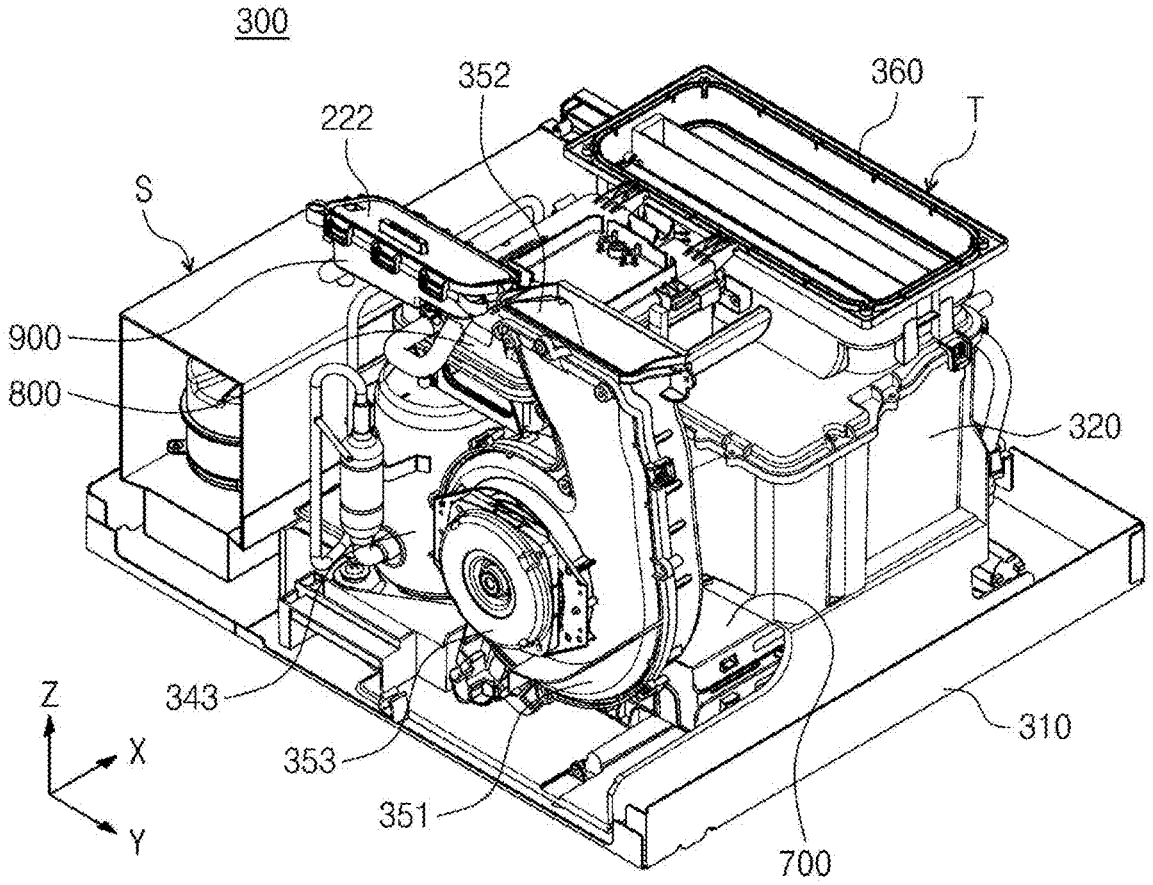
FIG. 7 is a rear view of the machine room.

FIG. 7 is a rear view of the machine room.

The blower 350 may include a blower fan 353 that provides power for air inside the circulation duct 320 to flow in one direction, and a fan housing 351 that accommodates the blower fan 353 therein and is coupled to or extended from the circulation duct 320.

The blower 350 may include an exhaust duct 352 that allows the circulation duct 320 and the exhaust hole 231 to be in communication with each other.

The exhaust duct 352 may be formed with a cross-section extending from the fan housing 351 toward exhaust hole 231 in an area size corresponding to that of exhaust hole 231.

As a result, air inside the inner casing 200 may be introduced via the base cover 360, pass through the circulation duct 320, and then be supplied back into the inner casing 200 via a fan installation portion 350.

The heat supply 340 may include a compressor 343 installed on the base 310 to exchange heat with air flowing through the circulation duct 320. The compressor 343 may be disposed on a left or right side of the circulation duct 320, and may be disposed between the circulation duct 320 and the ironing module S.

Figure 8:
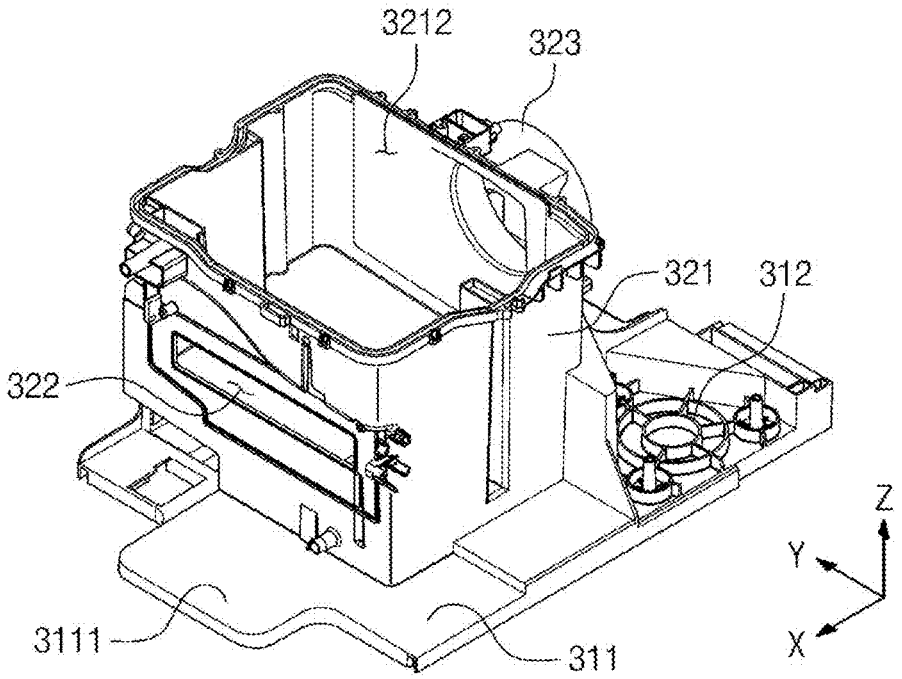
FIG. 8 shows structures of a circulation duct and a base in a machine room of a laundry treating apparatus of the present disclosure.

FIG. 8 shows structures of a circulation duct and a base in a machine room of a laundry treating apparatus of the present disclosure.

The base 310 may form a bottom surface of the laundry treating apparatus.

The base 310 may include a base bottom 311 forming a support surface. The base bottom 311 may form the bottom surface of the laundry treating apparatus.

In one example, the base bottom 311 may be seated on a top surface of the bottom surface of the cabinet 100 separately disposed to form the bottom surface of the laundry treating apparatus.

The base 310 may be integrally formed with the circulation duct 320 that forms at least a portion of the flow channel through which air flows. The circulation duct 320 may be formed by extending upward from the base bottom 311.

The circulation duct 320 may include a duct body 321 that extends from the base bottom 311 to form the flow channel, a heat exchanger installation portion 3212 that provides a space in which an evaporator 341 or a condenser 342 is installed inside the duct body 321, and an air discharger 323 that is disposed at the rear of the duct body 321 and discharges air in the duct body 321 to the blower 350.

The air discharger 323 may be formed in a pipe shape that extends rearward from the duct body 321. A diameter of the air discharger 323 may be smaller than a width of the duct body 321.

The air discharger 323 may be connected to the blower 350. Air discharged from the air discharger 323 may be guided into the inner casing 200 via the blower 350.

The circulation duct 320 may further include an outside air intake portion 322 defined by extending through a front surface of the duct body 321. The outside air intake portion 322 may be in communication with the outside air duct 370. The outside air duct 370 may be seated and supported in front of the outside air intake portion 322.

The circulation duct 320 may be installed with a damper that opens and closes the outside air intake portion 322. Opening and closing of the damper may allow or block inflow of outside air into the circulation duct 320.

The base 310 may include a compressor installation portion 312 that provides a space in which the compressor 343 is installed. The compressor installation portion 312 may be formed at one side of the base bottom 311 and may be formed integrally with the base bottom 311.

The compressor installation portion 312 may also have a protrusion formed that may support the compressor 343. The compressor installation portion 312 may be disposed to be biased to a rear side of the base 310. The compressor installation portion 312 may be disposed to at least partially overlap the air discharger 323 in a width direction.

A buffer member that reduces vibration transmitted from the compressor 343 may be installed in the compressor installation portion 312. The buffer member may be fixed to the protrusion.

The base 310 may include a compressor installation portion 312 in which the compressor 343, which supplies the refrigerant to the heat exchanger 341 and 343, is installed. The compressor installation portion 312 may be disposed outside the circulation duct 320.

The ironing module S may be seated on the compressor installation portion 312 or at one side of the base 310. The ironing module S may also be seated on the base 310. For example, the base bottom 311 may extend from the circulation duct 320 to edges of both side surfaces of the machine room 300, and the ironing module S may be seated on the base bottom 311.

In addition, the ironing module S may be installed in the machine room 300 by being disposed outside the base bottom 311. That is, the base bottom 311 may have a smaller area size than the bottom surface of the machine room 300, and the ironing module S may form a remaining bottom surface of the machine room 300.

Figure 9:
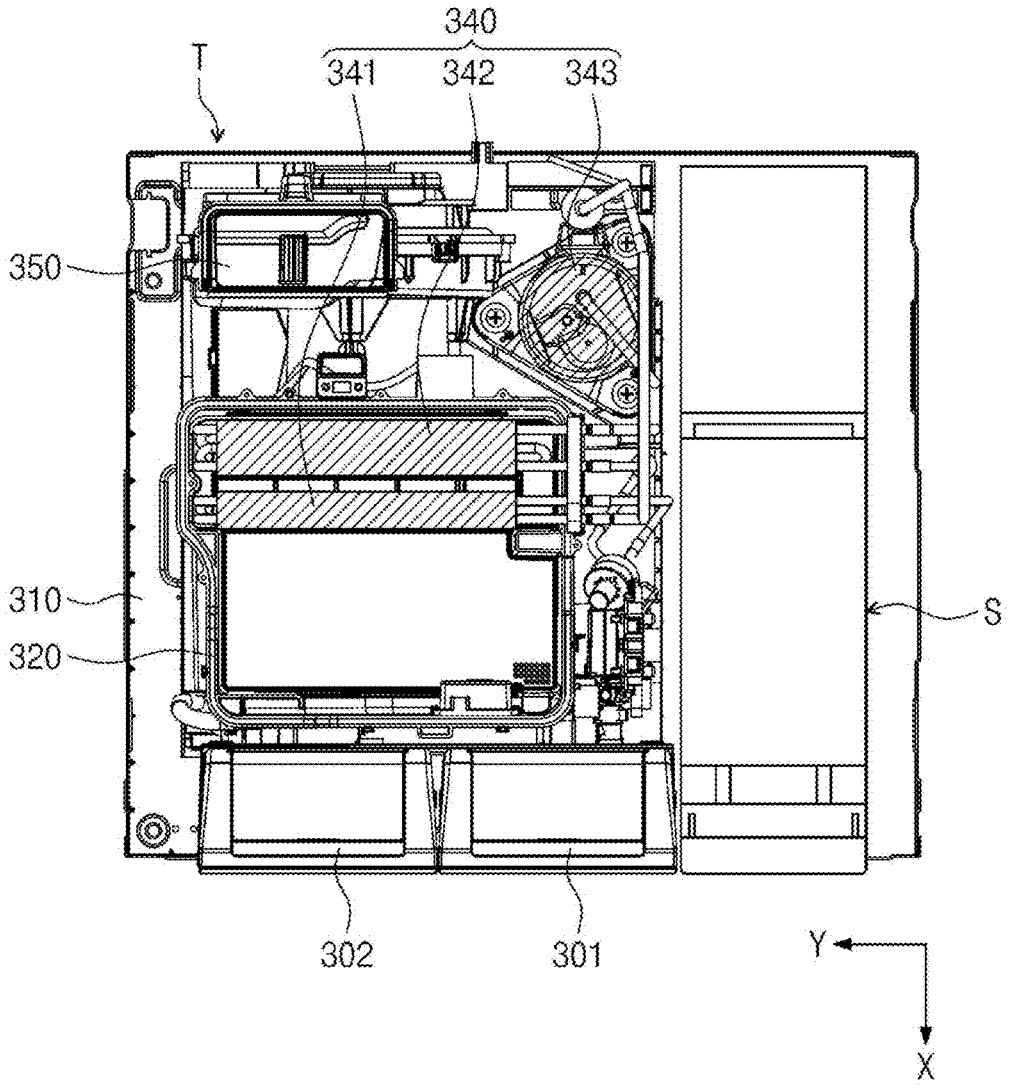
FIG. 9 shows inside of a circulation duct of a laundry treating apparatus of the present disclosure.

FIG. 9 shows inside of a circulation duct of a laundry treating apparatus of the present disclosure.

The circulation duct 320 may extend upward from the base bottom to form the flow channel through which air flows.

The heat supply 340 may include the evaporator 341 that cools and condenses air flowing along the circulation duct 320, the compressor 343 that receives the refrigerant from the evaporator 341 and compresses and heats the refrigerant, and the condenser 342 that receives the refrigerant from the compressor 343 and heats air flowing along the circulation duct 320.

The heat supply 340 may further include an expansion valve that expands the refrigerant that has passed through the condenser 342 to lower a temperature of the refrigerant.

The heat supply 340 may include the evaporator 341 that is installed inside the circulation duct 320 and is equipped as a heat exchanger that cools and dehumidifies air that has been introduced into the circulation duct 320, the condenser 342 that is equipped as a heat exchanger that heats air that has passed through the evaporator 341 to generate hot air, the compressor 343 that supplies the refrigerant that exchanges heat with air to the condenser 342 and is disposed outside the circulation duct 320, and an expansion valve 344 that expands and cools the refrigerant that has passed through the condenser 342.

The evaporator 341 and the condenser 342 may be disposed inside the circulation duct 320, and the compressor 343 may be disposed outside the circulation duct 320.

The circulation duct 320 may include the heat exchanger installation portion 3212 that provides a space in which the evaporator 341 and the condenser 342 are installed. The heat exchanger installation portion 3212 may be defined inside the duct body 321.

The duct body 321 may have an open top surface. The condenser 343 and the evaporator 341 may be introduced via the opening of the duct body 321 and installed.

The opening of the duct body 321 may be shielded by the base cover 360, and the base cover 360 and the duct body 321 may form a flow channel through which air flows inside the circulation duct 320.

A front surface of the duct body 321 may be disposed to be spaced rearwardly apart from a front end of the base bottom 311. As a result, the base bottom 311 may secure a support surface 3111 on which at least one of the water supply tank 301, the drainage tank 302, and the outside air duct 370 described above is installed and supported.

In one example, as the duct body 321 is integrally formed with the base 310, a height of the heat exchanger installation portion 3212 may be secured greater and heights of the condenser 343 and the evaporator 341 may also be increased to that extent accordingly.

As a result, widths in the front and rear direction of the condenser 343 and the evaporator 341 may be reduced, so that the number of refrigerant pipes passing through the condenser and the evaporator may be reduced. In addition, an effect of reducing a flow loss of air passing through the condenser and the evaporator is derived.

In one example, a sum of a length of the evaporator 341 and a length of the condenser 343 may be smaller than a length of the heat exchanger installation portion 3212. Accordingly, the length in the front and rear direction of the heat exchanger installation portion 3212 may be equal to or smaller than half of the length of the duct body 321.

The blower 350 may be disposed to overlap the condenser 343 or the evaporator 341 in the front and rear direction. Therefore, air that has passed through the evaporator 341 and the condenser 343 may be introduced into the blower 350 without bending of the flow channel. That is, in a process in which air introduced into the circulation duct 320 flows to the blower 350, because there is no bending in the flow channel, the flow loss may be minimized.

A length of the ironing module S may be greater than a length of the circulation duct 320.

Figure 10:
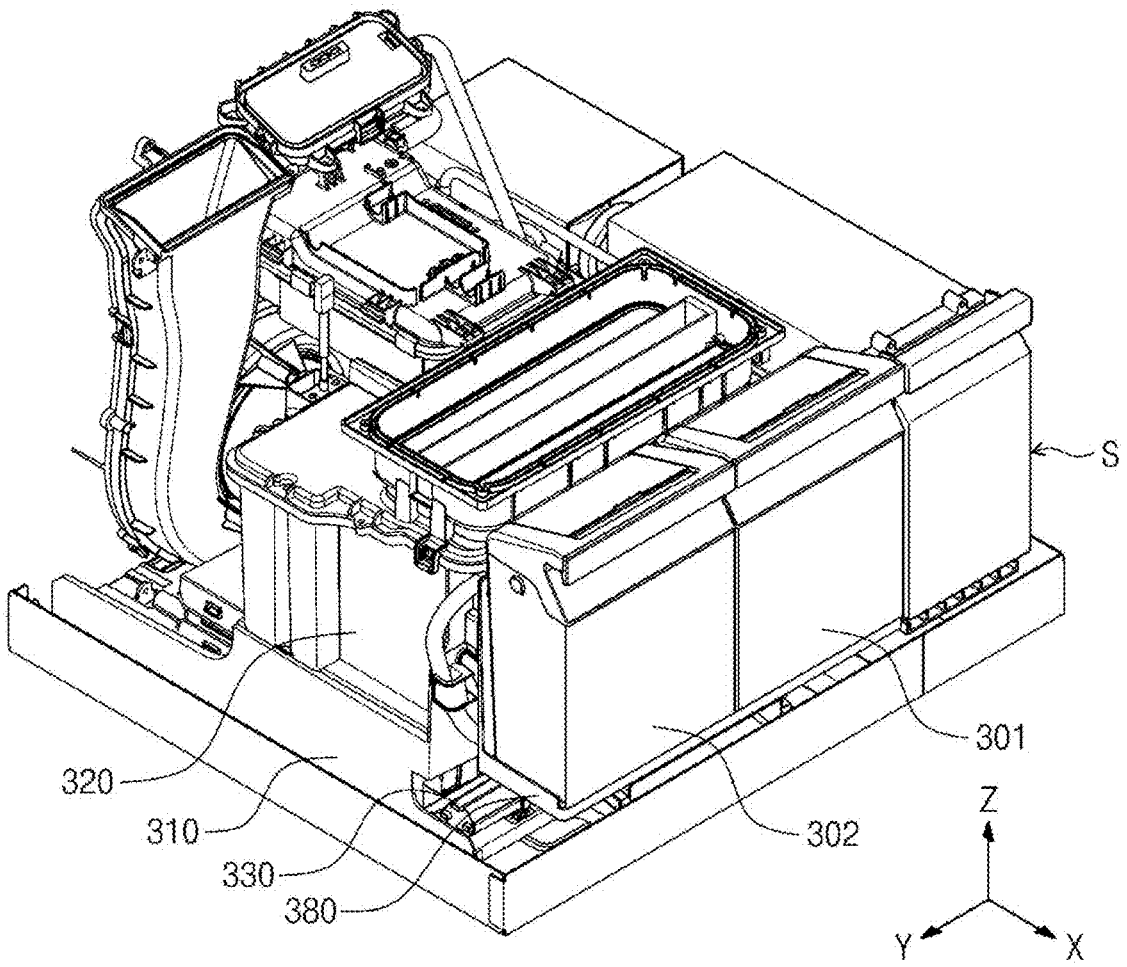
FIG. 10 shows a water supply and drainage system of a laundry treating apparatus of the present disclosure.

FIG. 10 shows a water supply and drainage system of a laundry treating apparatus of the present disclosure.

The laundry treating apparatus of the present disclosure may include the water supply tank 301 that supplies water to the steam supply 800 and the drainage tank 302 that collects condensed water from the circulation duct 320 or the ironing module S.

The water supply tank 301 and the drainage tank 302 should be selectively separated from each other in the machine room 300 for the user to easily fill the water supply tank 301 with water and discard water collected in the drainage tank 302.

The machine room 300 may further include a detachment portion 380 disposed in front of the refreshing module T to support the water supply tank 301 and the drainage tank 302. The detachment portion 380 may be detachably coupled to the water supply tank 301 and the drainage tank 302.

The detachment portion 380 may be formed in a plate shape to prevent the inside of the machine room 300 from being exposed.

A drainage pump 331 or the like may be disposed under the detachment portion 380, and the circulation duct 320 may be disposed at the rear of the detachment portion 380.

A portion of the ironing module S may extend through the detachment portion 380.

The ironing module S may be disposed on one side of one of the water supply tank 301 and the drainage tank 302. The ironing module S may not be disposed between the water supply tank 301 and the drainage tank 302. As a result, the length in the front and rear direction of the ironing module S may be sufficiently secured.

The ironing module S may be disposed closer to the water supply tank 301 than to the drainage tank 302. As a result, water may be easily supplied from the water supply tank 301, heated, and delivered to the steam iron 1300, a structure of receiving water from the water supply tank 301 may be simply designed, and a volume occupied by the structure may also be minimized.

Figure 11:
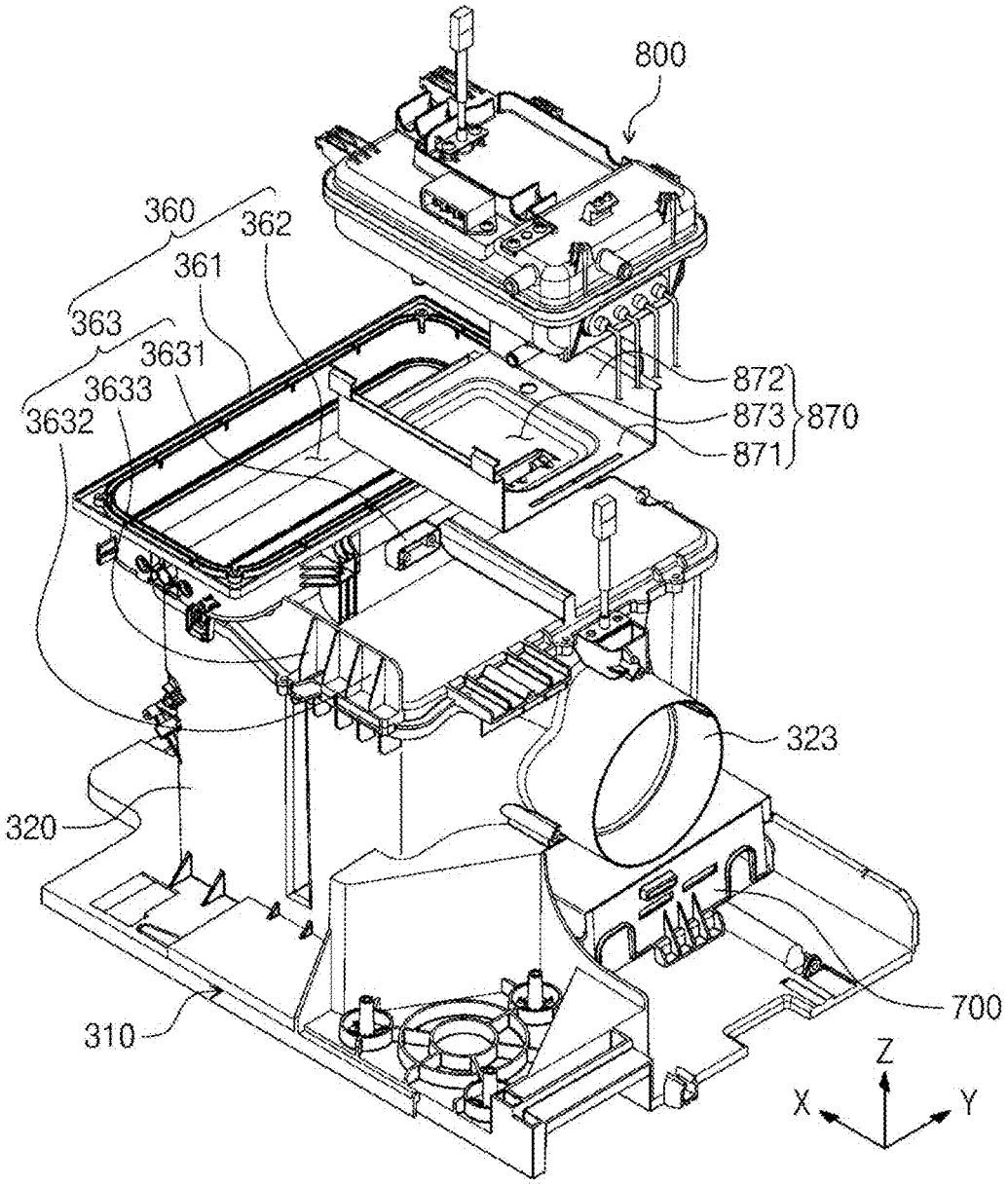
FIG. 11 shows an installation structure of a steam supply that receives water from a water supply tank.

FIG. 11 shows an installation structure of a steam supply that receives water from a water supply tank.

The steam supply 800 may be supported by being seated on the base cover 360.

The base cover 360 may include an inflow body 361 that is coupled to the top surface of the circulation duct 320 to allow the inner casing 200 and the circulation duct 320 to be in communication with each other, and a shielding body 363 that extends from the inflow body 361 to shield the top surface of the circulation duct 320.

The inflow body 361 may be formed in a duct shape and allow the inflow hole 232 of the inner casing and the inside of the circulation duct 320 to be in communication with each other. The inflow body 361 may protrude upwardly of the shielding body 363.

The inflow body 361 may be disposed in front of the evaporator 341 so as not to face the evaporator 341 and the condenser 343.

The inflow body 361 may serve as an inflow duct that allows air in the inner casing 200 to flow to the circulation duct 320. The inflow body 361 may be equipped with the inlet 362 through which air in the inner casing 200 may pass.

The inlet 362 may be partitioned into a plurality of sections, and a filter may be inserted into and installed in one of the sections.

The shielding body 363 may include a blocking panel 3631 that blocks the evaporator 341 and the condenser 343 from being exposed to the outside and supports the steam supply 800, a power terminal 3633 that extends from the blocking panel 3631 or the inflow body 361 and supplies power to the steam supply 800, and a protective panel 3632 that accommodates therein and protects one of both side surfaces of the steam supply 800.

A plurality of reinforcing ribs that reinforce rigidity may be disposed on an outer surface of the protective panel 3632. This prevents vibration or impact generated in the inner casing 200 or the machine room 300 from being transmitted to the steam supply 800.

The steam supply 800 may be supported by being seated on the base cover 360.

The steam supply 800 may include a steam casing 810 that stores water that generates steam.

The steam supply 800 may further include an installation bracket 870 that may fix the steam casing 810 to the base cover 360.

The installation bracket 870 may be coupled to the base cover 360 to fix the steam casing 810.

The installation bracket 870 may include a lower panel 871 that supports a bottom surface of the steam casing 810 and side panels 872 that support both side surfaces of the steam casing 810 on the lower panel 871.

The installation bracket 870 may further include a support panel 873 that extends stepwise from the lower panel 871 and supports the bottom surface of the steam casing 810. As a result, the lower panel 871 may accommodate therein and support a portion of the bottom surface of the steam casing 810.

The compressor 343 may be disposed under the steam supply 800.

The installation bracket 870 may block heat generated from the compressor or heat generated from the refrigerant compressed in the compressor from being transferred to the steam supply 800.

The installation bracket 870 may also block fire from being transferred to the steam supply 800 in the event of fire occurring in the compressor 343.

In one example, the base cover 360 may include a fastener 3631 that is disposed on the shielding body 363 and detachably coupled with the steam supply 800. The fastener 3631 may be formed in a structure that is detachably coupled with a protruding portion protruding from a lower portion of the steam casing 810.

Therefore, even when a large amount of water is contained inside the steam casing 810, the steam casing 810 may be stably seated on the base cover 360.

In addition, because the steam casing 810 is disposed upward of the circulation duct 320 and has a shorter distance to the inner casing 200, condensation of steam generated in the steam casing 810 before reaching the inner casing 200 may be minimized.

Figure 12:
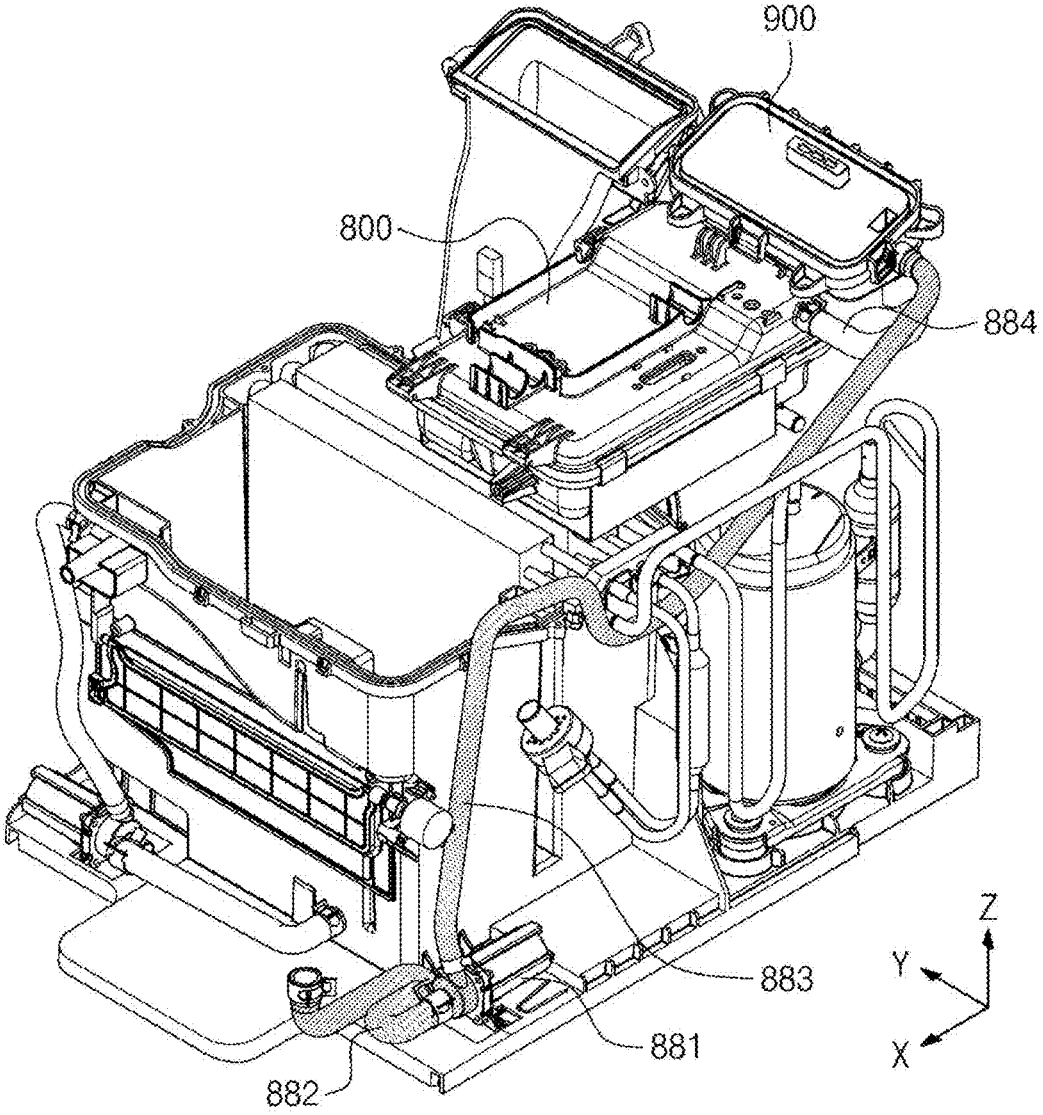
FIG. 12 shows a structure of supplying water to the steam supply.

FIG. 12 shows a structure of supplying water to the steam supply.

Steam generated inside the steam casing 810 may be directly supplied into the inner casing 200 via a steam pipe 823.

However, when steam is directly supplied into the inner casing 200 via the steam pipe 823, there is a concern that water contained in the steam casing 810 may also be discharged into the inner casing 200. In addition, there is a concern that water heated in the steam casing 810 may heat the bottom surface of the inner casing 200, causing thermal damage to the inner casing 200.

To prevent such problem, the steam supply 800 of the present disclosure may further include the steam nozzle 900 that receives steam generated in the steam casing 810 and supplies steam to the inner casing 200.

The steam nozzle 900 may be disposed to be spaced apart from the steam casing 810, and may receive only steam formed in the steam casing 810 and not receive water contained in the steam casing 810.

For example, the steam nozzle 900 may be disposed upward of the steam casing 810 and may be connected thereto via the steam pipe 823. Accordingly, steam generated in the steam casing 810 may rise because of a density difference and be supplied to the steam nozzle 900 along the steam pipe 823, and water contained in the steam casing 810 may not be introduced into the steam pipe 823 or the steam nozzle 900 because of gravity.

The steam nozzle 900 may be disposed between the bottom surface of the inner casing 200 and the steam casing 810, and may be in communication with the steam hole 233.

In one example, the steam supply 800 of the present disclosure may receive water from the water supply tank 301 and generate steam.

To this end, the laundry treating apparatus of the present disclosure may include a water supply 880 that supplies water contained in the water supply tank 301 to the steam supply 800.

The water supply 880 may include a water supply pump 881 that provides a pressure to supply water supplied to the water supply tank 301 to the steam supply 800 or the steam nozzle 900, a supply pipe 882 that is in communication with the water supply tank 301 and delivers water to the water supply pump 881, and a connection pipe 883 that connects the water supply pump 881 with the steam nozzle 900.

The supply pipe 882 may be formed as a hose connecting the water supply tank 301 with the water supply pump 881, and the connection pipe 883 may be formed as a hose connected to the water supply pump 881.

The laundry treating apparatus of the present disclosure may supply water contained in the water supply tank 301 to the steam nozzle 900 rather than to the steam casing 810.

The water supply pump 881 may not be directly connected to the steam casing 810.

The steam nozzle 900 may receive water via the connection pipe 883 and then supply water to the steam supply 800 via a water supply pipe 884. The water supply pipe 884 may be connected to a recovery pipe 824.

Because the steam nozzle 900 is disposed upward of the steam casing 810, water supplied to the steam nozzle 900 may be automatically supplied to the steam casing 810 via the water supply pipe 884.

The steam pipe 823 through which steam is introduced into the steam nozzle 900 and the recovery pipe 824 through which water is discharged from the steam nozzle 900 may be formed as separate flow channels. Therefore, water supplied from the steam nozzle 900 may be prevented from interfering with flow of steam supplied from the steam casing 810.

In one example, the water supply pipe 884 may be formed in a U-shape. That is, a middle area of the water supply pipe 884 may be disposed at a lower vertical level than both ends thereof. As a result, a certain amount of water, like a water trap, may be accumulated in the water supply pipe 884, thereby preventing steam or water supplied from the steam casing 810 from being re-introduced via the water supply pipe 884.

In addition, because the steam casing 810 is not directly connected to the water supply pump 881, a possibility that water introduced into the steam casing 810 may flow back into the water supply pump 881 may be blocked.

In addition, a large amount of water may be supplied to the steam nozzle 900 at a considerable pressure via the water supply pump 881. As a result, foreign substances, bacteria, or the like accumulated or growing in the steam nozzle 900 may be washed away by water supplied to the steam nozzle 900 and may go down into the steam casing 810. Therefore, the steam nozzle 900 may always be maintained in a clean state.

In one example, when steam supplied from the steam nozzle 900 is condensed, condensed water may be re-introduced into the steam casing 810 via the water supply pipe 884. That is, condensate generated from the steam nozzle 900 may be recovered into the steam casing 810 in the same direction as a flow direction of water supplied from the water supply pump 881, and may be recycled as water that generates steam. Therefore, the laundry treating apparatus of the present disclosure may prevent a water level of the water supply tank 301 from rapidly decreasing and also prevent waste of water.

Figure 13:
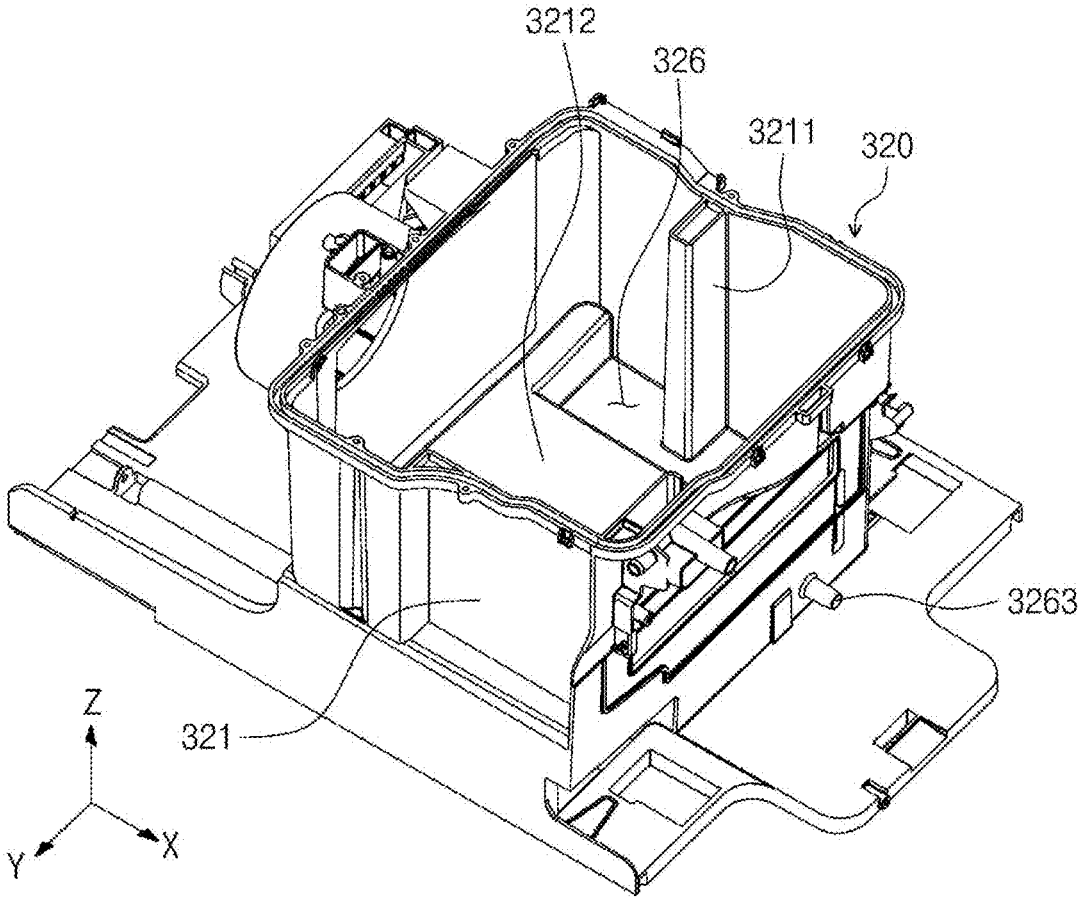
FIG. 13 shows a drainage structure of a laundry treating apparatus of the present disclosure.

FIG. 13 shows a drainage structure of a laundry treating apparatus of the present disclosure.

In the laundry treating apparatus of the present disclosure, when the compressor 343 and the blower fan 353 are operated, air supplied from the outside of the cabinet 100 and air supplied from the inner casing 200 are cooled while passing through the evaporator 341, and water vapor contained in the air is condensed.

Water condensed in the evaporator 341 may accumulate on the bottom surface of the circulation duct 320.

The laundry treating apparatus of the present disclosure may include a reservoir 326 defined as a portion of the bottom surface of the duct body 321 is recessed to collect condensate condensed in the evaporator 341.

The reservoir 326 is a space defined as the portion of the bottom surface of the duct body 321 is recessed, and is able to form one side surface of a controller installation portion 313.

The reservoir 326 may be defined to be recessed downward from the bottom surface of the circulation duct 320.

The reservoir 326 may be formed integrally with the circulation duct 320. The reservoir 326 may be formed by forming the portion of the bottom surface of the circulation duct 320 to be recessed while injection-molding the circulation duct 320 onto the base 310.

The reservoir 326 may have at least a portion of a top surface thereof disposed parallel to the heat exchanger installation portion 3212.

The base 310 may include a guide pipe 3263 that discharges water collected in the reservoir 326 to the outside.

The guide pipe 3263 may protrude from a lower portion of the reservoir 326 to the outside of the circulation duct 320. The guide pipe 3263 may discharge water stored in the reservoir to the outside of the base. This may prevent water collected in the reservoir 326 from decaying or flowing back to the bottom surface of the circulation duct 320.

The circulation duct 320 may include a partition wall 3211 that extends from an inner surface of the duct body 321. The partition wall 3211 may protrude inwardly from an inner wall of the circulation duct 320, or an outer wall of the circulation duct 320 may be recessed inward and protrude inward. The partition wall 3211 may guide a location where the heat exchanger 341 and 343 is installed, and may prevent air entering the heat exchanger from passing by bypassing the heat exchanger. The partition wall 3211 may be disposed in the reservoir 326.

Figure 14:
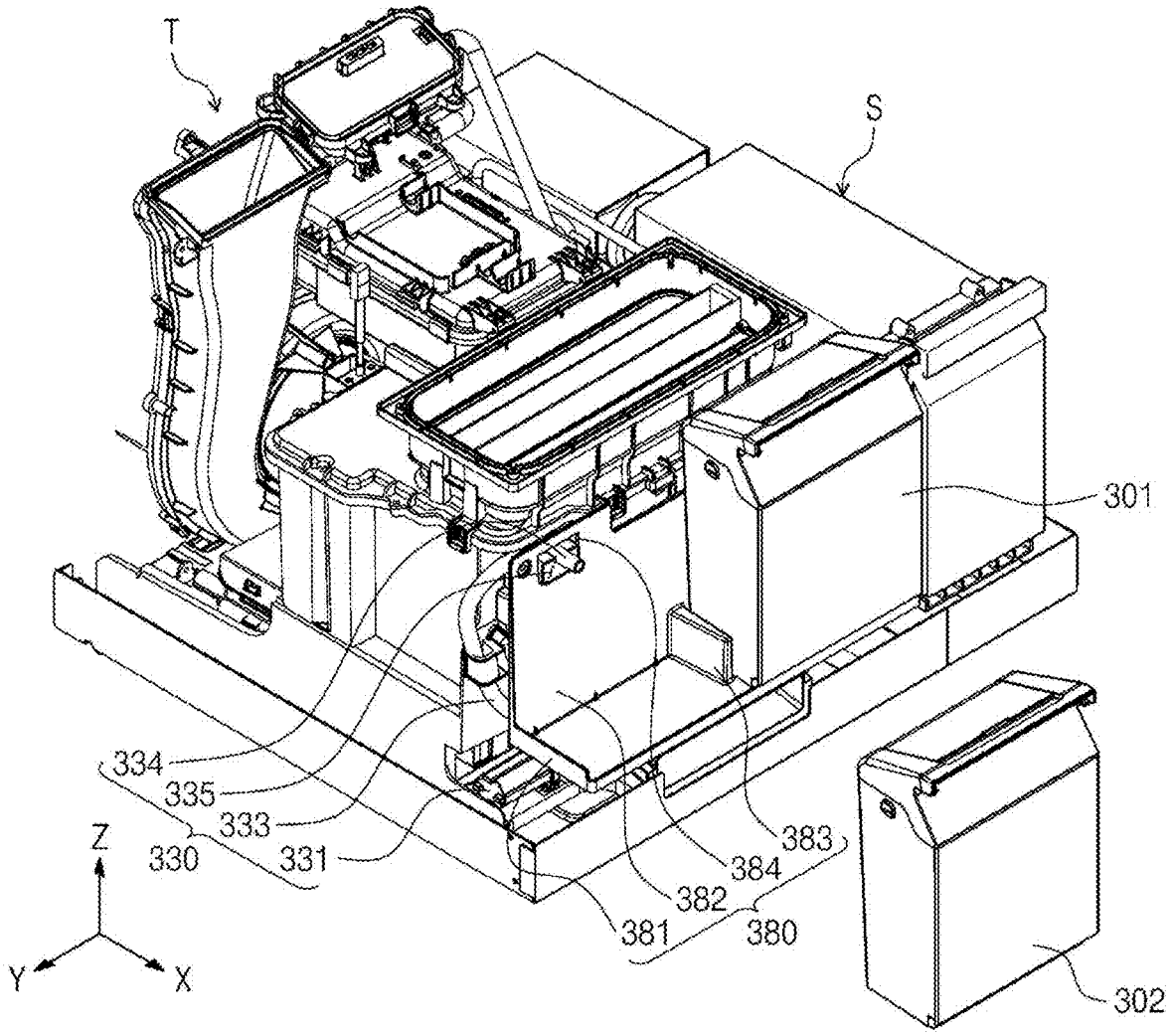
FIG. 14 shows a drainage tank installation structure of a laundry treating apparatus of the present disclosure.

FIG. 14 shows a drainage tank installation structure of a laundry treating apparatus of the present disclosure.

The drainage tank 302 may be formed in a shape of a box that stores water.

The drainage tank 302 may include a supply hole for receiving water defined in a rear surface, and the supply hole may be defined closer to an upper end than to the bottom surface of the drainage tank 302.

The detachment portion 380 may include a load support 381 on which at least one of the drainage tank 302, the water supply tank 301, and the ironing module S may be supported, and a detachment support 382 disposed on the load support 381 in front of the circulation duct 320 and on which the drainage tank 302 and the water supply tank 301 may be seated.

The load support 381 may be formed in a plate shape to support bottom surfaces of the water supply tank 301 and the drainage tank 302, and the detachment support 382 may also be formed in a plate shape to support rear surfaces of the water supply tank 301 and the drainage tank 302.

The detachment portion 380 may include a detachment separator 383 protruding from the load support 381 so as to be disposed between the water supply tank 301 and the drainage tank 302. The detachment separator 383 may separate the water supply tank 301 and the drainage tank 302 from each other by a predetermined spacing. As a result, when one of the water supply tank 301 and the drainage tank 302 is withdrawn, the other of the water supply tank 301 and the drainage tank 302 may be prevented from being withdrawn arbitrarily.

The laundry treating apparatus of the present disclosure may further include a drainage 330 that collects water condensed in the circulation duct 320 into the drainage tank 302.

The drainage 330 may include the drainage pump 331 that receives water from the guide pipe 3263 and a drainage hose 333 that receives water from the drainage pump 331 and guides water to the drainage tank 302.

The drainage 330 of the present disclosure may further include a discharge pipe 334 that allows the drainage hose 333 and the drainage tank 302 to be in communication with each other. The discharge pipe 334 may receive water from the drainage hose 333 and guide water into the drainage tank 302.

In one example, the discharge pipe 334 may be directly connected to the drainage hose 333 or may be formed integrally with the drainage hose 333.

However, the laundry treating apparatus of the present disclosure may install the discharge pipe 334 in the circulation duct 320 such that water may be continuously supplied even when a water level inside the drainage tank 302 reaches a full level, and the circulation duct 320 may be constructed to receive water flowing back from the discharge pipe 334 or the drainage tank 302 again therein.

As a result, the circulation duct 320 and the reservoir 326 may temporarily perform the role of the drainage tank 302 to expand a water storage capacity. As a result, water may be prevented from overflowing out of the drainage tank 302.

For example, the detachment portion 380 may include a detachment communication portion 384 that is defined to extend through the detachment support 382 so as to allow the drainage hose 333 and the drainage tank 302 to be in communication with each other.

The detachment communication portion 384 may be defined in an area facing the supply hole defined in the drainage tank when the drainage tank 302 is seated on the load support 381.

The discharge pipe 334 may extend from the circulation duct 320 or may extend from the detachment portion 380. The discharge pipe 334 may be formed as an injection-molded product. Accordingly, the discharge pipe 334 may stably fix a distal end of the drainage hose 333 and prevent the drainage hose 333 from being bent abruptly.

In addition, the discharge pipe 334 may be formed as an injection-molded product in a shape of a pipe fixed to the circulation duct 320 or the support 381, so that an installation location thereof may always be fixed. Accordingly, a distal end of the discharge pipe 334 and the supply hole defined in the drainage tank 302 are always positioned in correct locations, so that condensate supplied from the drainage pump 331 may be stably introduced into the drainage tank 302.

The laundry treating apparatus of the present disclosure may further include a backflow portion 335 that allows water contained inside the drainage tank 302 to flow back into the circulation duct 320 or the drainage 330.

The backflow portion 335 may be formed under the discharge pipe 334 and may allow the circulation duct 320 and the inside of the drainage tank 302 to be in communication with each other. The backflow portion 335 may receive water inside the drainage tank 302 and guide water into the circulation duct 320.

Figure 15:
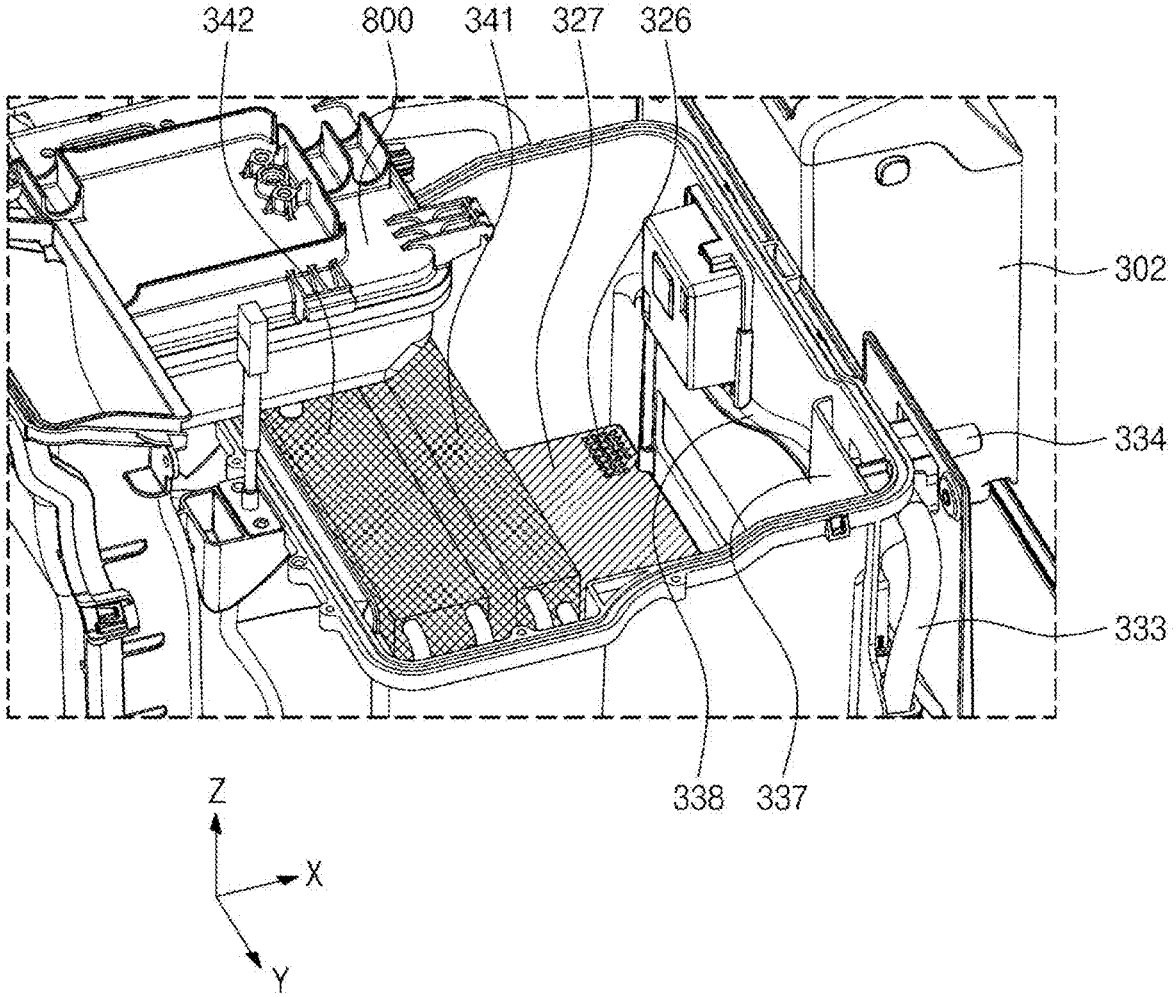
FIG. 15 shows in detail a structure of a backflow portion of a laundry treating apparatus of the present disclosure.

FIG. 15 shows in detail a structure of a backflow portion of a laundry treating apparatus of the present disclosure.

The circulation duct 320 may have the evaporator 341 and the condenser 343 disposed therein. In this regard, the evaporator 341 may be disposed in front of the condenser 343 in the circulation duct 320.

The backflow portion 335 may be defined in a front surface of the circulation duct 320. In this regard, when water introduced into the circulation duct 320 from the backflow portion 335 comes into contact with the evaporator 341 or the like, the evaporator 341 may be unnecessarily corroded or contaminated and an efficiency of the evaporator 341 in cooling air may decrease.

Therefore, to prevent water supplied from the backflow portion 335 from coming into contact with the evaporator 341 along air directed toward the evaporator 341, the evaporator 341 may be disposed closer to a rear side of the circulation duct 320 than the backflow portion 335.

The backflow portion 335 or the discharge pipe 334 may be exposed forward of the circulation duct 320 by extending through the detachment communication portion 384. When the drainage tank 302 is seated on the detachment support 382, a distal end of the backflow portion 335 or the discharge pipe 334 may be inserted into the drainage tank 302.

As a result, water discharged out of the circulation duct 320 via the drainage pump 331 may be collected in the drainage tank 302 along the drainage hose 333 and the discharge pipe 334.

When the water level of the drainage tank 302 reaches the discharge pipe 334 or the backflow portion 335, water overflowing out of the backflow portion 335 may be introduced into the circulation duct 320 again along the backflow portion 335 and be prevented from leaking out of the machine room 300.

A guide flow channel 338 may extend along a width direction of the front surface of the circulation duct 320. One end of the guide flow channel 338 may be disposed to be in communication with the backflow portion 335, and the other end thereof may be disposed above the reservoir 326.

In addition, the circulation duct 320 may further include a blocking wall 337 that guides water introduced from the backflow portion 335 to the guide flow channel 338.

Figure 16:
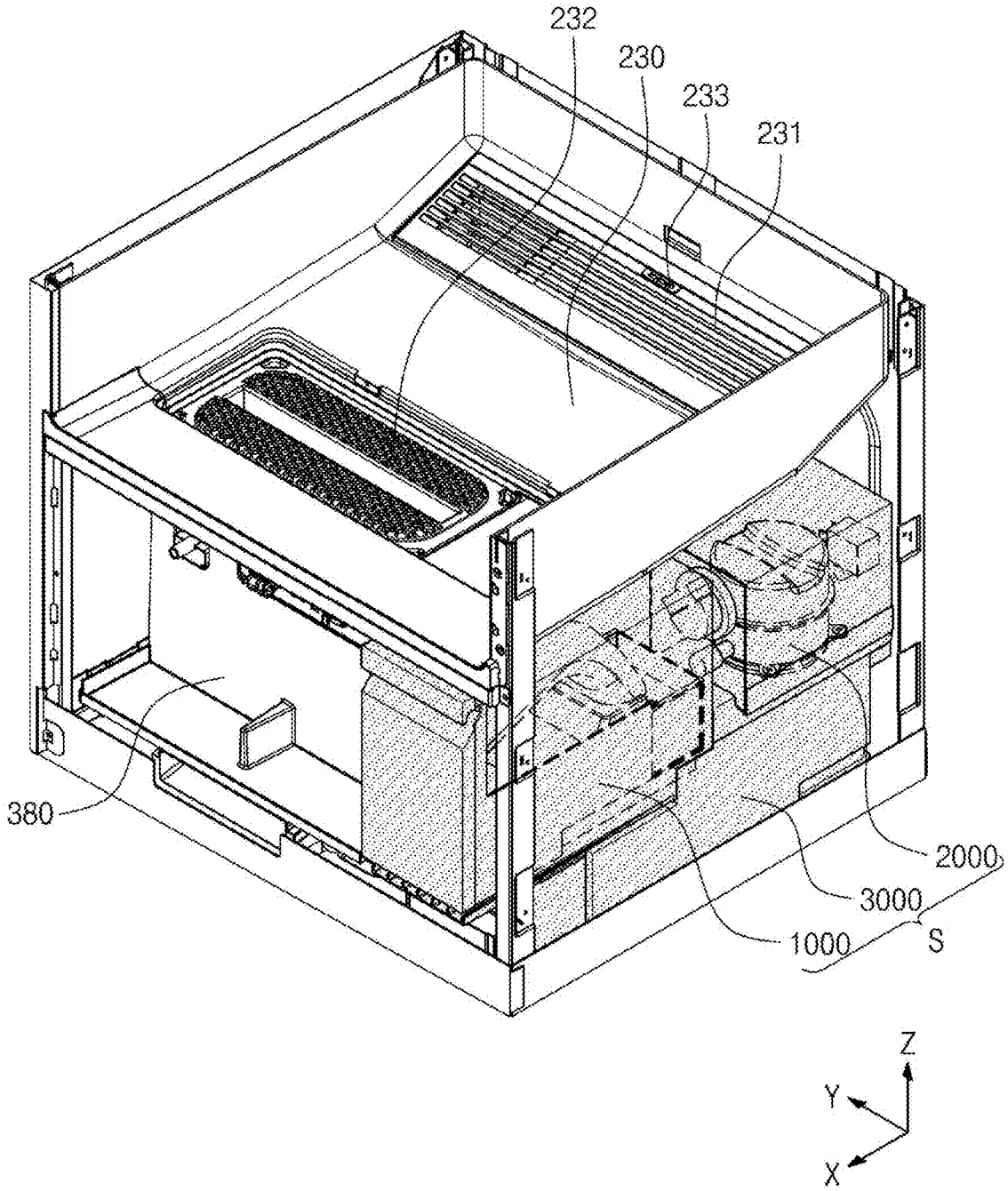
FIG. 16 shows a lower configuration of a bottom surface of an inner casing.

FIG. 16 shows a lower configuration of a bottom surface of an inner casing.

The bottom surface 230 may introduce air inside the inner casing 200 into the circulation duct 320 via the inflow hole 232, and may receive air dehumidified and heated while passing through the circulation duct 320, via the exhaust hole 231. In addition, steam supplied from the steam supply 800 may be received via the steam hole 233.

However, the bottom surface 230 except for the through-holes may block air, moisture, and foreign substances inside the inner casing 200 from flowing out into the machine room 300.

The detachment portion 380 may be disposed in a front side of the machine room 300 to prevent external air, moisture, and foreign substances from being introduced into the machine room 300.

The laundry treating apparatus of the present disclosure may install the ironing module S in the machine room 300. As a result, the ironing module S may be prevented from being exposed to air, moisture, and the foreign substances inside the inner casing 200.

In addition, the machine room 300 may have the entire components disposed under the bottom surface 230, so that the machine room 300 may be disposed and installed independently of the inner casing 200. As a result, the machine room 300 may be manufactured as a module and installed in the cabinet 100.

The ironing module S may be installed in the machine room 300 in a modular manner. Therefore, the ironing module S may also be selectively installed in the machine room 300 without affecting the internal configurations of the machine room 300 and the cabinet 100.

Therefore, even when the laundry treating apparatus of the present disclosure is a product that does not have the ironing module S, the ironing module S may be installed in the machine room 300 in the future.

The ironing module S may be disposed to one of both side surfaces of the machine room 300. The ironing module S may minimize interference with existing components such as the circulation duct 320.

The ironing module S may further include a storage module 1000 that may store the steam iron 1300, which supplies at least one of heat and steam to the laundry, inside the machine room 300, and a heating module 2000 including the steam generator 2100, which generates at least one of heat and steam to be supplied to the steam iron 1300.

The heating module 2000 may be disposed at the rear of the storage module 1000, and the storage module 1000 may be exposed forward of the machine room 300. As a result, the steam iron 1300 may be withdrawn forward of the machine room 300 and be accessible to the laundry.

The detachment portion 380 may have a passage surface that supports the steam iron 1300 so as to be withdrawn forward from the inside of the machine room 300.

The ironing module S may further include a base module 3000 that supports the storage module 1000 and the heating module 2000. The base module 3000 may provide a space in which the storage module 1000 and the heating module 2000 are installed, and may fix locations and a connected state of the storage module 1000 and the heating module 2000.

In addition, the base module 3000 may be constructed to position the storage module 1000 and the heating module 2000 above the base 310 or the bottom surface of the cabinet by a predetermined vertical dimension or more.

As a result, condensed water or residual water in the storage module 1000 and the heating module 2000 may be automatically discharged by gravity, and the storage module 1000 and the heating module 2000 may be prevented from being damaged by vibration or impact.

The storage module 1000 and the heating module 2000 may be mounted on the base module 3000 and installed inside the machine room 300.

In one example, when the storage module 1000 and the heating module 2000 may be stably installed in the machine room 300, the base module 3000 may be omitted.

Figure 17:
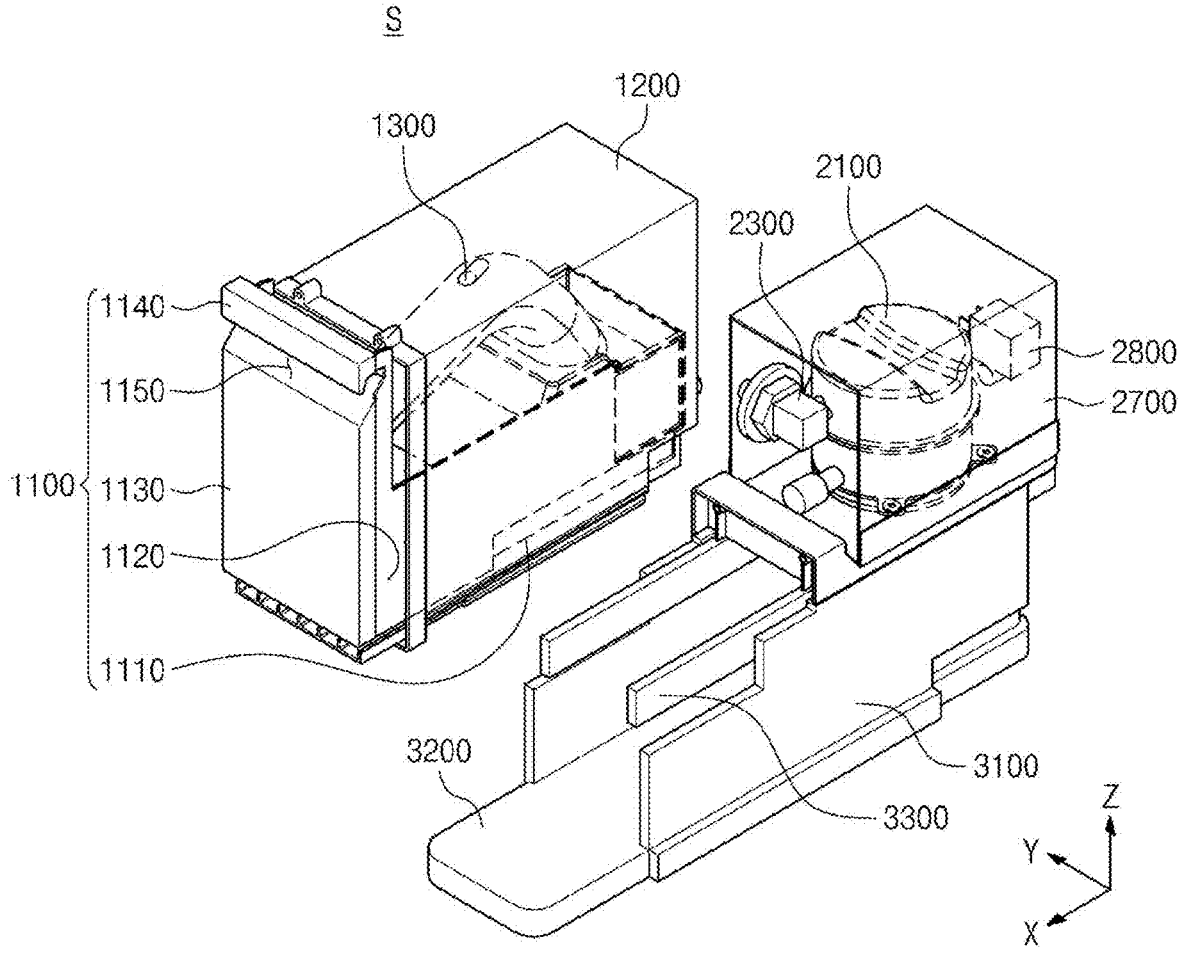
FIG. 17 shows a structure of the ironing module in detail.

FIG. 17 shows a structure of the ironing module in detail.

The storage module 1000, the heating module 2000, and the base module 3000 may be manufactured integrally, or may be manufactured separately and then coupled and fixed to each other.

Hereinafter, a description will be made based on the storage module 1000, the heating module 2000, and the base module 3000 being constructed as independent modules, but it is not excluded that they are manufactured integrally.

The storage module 1000, the heating module 2000, and the base module 3000 may be manufactured independently of each other and installed in the machine room 300. Accordingly, the storage module 1000, the heating module 2000, and the base module 3000, which have volumes smaller than that of the entire ironing module S, may be installed sequentially in the machine room 300, so that a work of installing the ironing module S in the machine room 300 may be easy.

In addition, when one of the storage module 1000, the heating module 2000, and the base module 3000 is damaged or defective, it is required to replace or repair only the specific module, so that maintenance and repair of the ironing module S may be easy.

The storage module 1000 may include the steam iron 1300 that may approach the laundry and supply at least one of heat and steam to the laundry.

The steam iron 1300 may have a surface, facing the laundry, made of a material that may transmit heat, so that when the steam iron 1300 comes into contact with the laundry, steam iron 1300 may remove the wrinkles from the laundry.

In addition, the steam iron 1300 may include a spray hole through which steam is sprayed onto the surface thereof facing the laundry, so that high-temperature steam may be supplied to the surface of the laundry to not only remove the wrinkles from the laundry, but also perform a refreshing process such as sterilization and deodorization of the laundry.

The steam iron 1300 may generate heat and steam by being supplied with power on its own, but may receive at least one of heat and steam from the heating module 2000 and transmit the same.

When the steam iron 1300 is equipped to receive at least one of heat and steam, a weight and a volume of the steam iron 1300 may be reduced, so that the user may easily lift the steam iron 1300 up to the surface of the laundry hung on the hanger or the fixer.

The storage module 1000 may further include the storage box 1200 that accommodates the steam iron 1300 therein. The storage box 1200 may be formed in a casing shape that has an accommodating space for storing the steam iron 1300 inside.

The storage box 1200 may serve to store the steam iron 1300 inside the machine room 300, and may perform a role of varying a location where the steam iron 1300 is arbitrarily stored inside the machine room 300.

A width of the storage box 1200 may be greater than a width of the steam iron 1300, and a length of the storage box 1200 may be greater than a length of the steam iron 1300.

For example, the width of the storage box 1200 may be about 1 to 3 cm greater than the width of the steam iron 1300. However, the width of the storage box 1200 may not be greater than the width of the steam iron 1300 by 5 cm or more. This may prevent the steam iron 1300 from vibrating or moving in the left and right direction inside the storage box 1200.

The storage box 1200 may have a length in the front and rear direction greater than a width in the left and right direction, and may have a height in the vertical direction greater than the width in the left and right direction. Accordingly, the steam iron 1300 may be stably inserted into and stored inside the storage box 1200.

The storage box 1200 may include the storage body 1210 that accommodates the steam iron 1300 therein, and the open surface 1220 defined in the front surface of the storage body 1210 and from which the steam iron 1300 may be withdrawn.

The storage body 1210 may accommodate the steam iron 1300 therein so as to block the steam iron 1300 from being exposed to an upper side, both side surfaces, and a rear side of the machine room.

The storage body 1210 may accommodate therein and withdraw the steam iron 1300 only through the open surface 1220. As a result, the steam iron 1300 may be exposed only forward of the machine room 300, and may be prevented from being exposed or withdrawn in other directions.

The open surface 1220 may open the entire front surface of the storage body 1210. When the steam iron 1300 is able to be withdrawn and inserted, only a portion of the front surface of the storage body 1210 may be opened.

The storage module 1000 may further include an extendable portion 1100 that exposes the steam iron 1300 forward of the storage box 1200.

The extendable portion 1100 may support the steam iron 1300 inside the storage box 1200. The steam iron 1300 may be seated on the extendable portion 1100 and stored inside the storage box 1200.

The extendable portion 1100 may expose at least a portion of the steam iron 1300 stored inside the storage box 1200 to the outside of the storage box 1200 The extendable portion 1100 may extend the steam iron 1300 forward of the storage box 1200 and expose the steam iron 1300 forward of the machine room 300 or the detachment portion 380. Accordingly, even when the steam iron 1300 is stored in the storage box 1200, the steam iron 1300 may be easily withdrawn out of the machine room 300.

The extendable portion 1100 may be of a drawer type that is extended forward from the storage box 1200, or may be of a hatch type that is opened by pivoting forward at a front side of the storage box 1200.

The extendable portion 1100 may be equipped as any component as long as it is able to selectively expose the steam iron 1300 forward of the storage box 1200 while storing the steam iron 1300 inside the storage box 1200.

The extendable portion 1100 may include a support 1120 on which the steam iron 1300 is mounted, and a cover 1130 disposed in front of the support 1120 to shield the open surface 1220.

The support 1120 may be accommodated in the storage box 1200 and fix the steam iron 1300. The support 1120 may be formed in a casing shape that accommodates the steam iron 1300 therein, or may be formed in a plate shape that supports a lower portion of the steam iron 1300. The support 1120 may be constructed as a drawer accommodated in the storage body 1210 and retracted and extended via the open surface 1220.

When the support 1120 is extended from the open surface 1220, the steam iron 1300 mounted on the support 1120 may be withdrawn forward of the storage box 1200, and when the support 1120 is inserted into the open surface 1220, the steam iron 1300 mounted on the support 1120 may be completely accommodated in the storage box 1200.

The extendable portion 1100 may further include a cover panel 1130 that extends from a front side of the support 1120 and shields the open surface 1220. The cover panel 1130 may prevent the inside of the storage body 1210 from being exposed to the outside via the open surface 1220. As a result, not only the steam iron 1300 accommodated in the storage body 1210, but also an entirety of the inside of the ironing module S may be prevented from being contaminated with foreign substances, steam, or air.

The cover panel 1130 may shield a through-hole defined to allow the extendable portion 1100 to be extended from the detachment portion 380. As a result, the inside of the machine room 300 may be prevented from being exposed to the outside because of the through-hole, and the foreign substances, steam, or air may be prevented from being introduced into the machine room 300.

An area size of the cover panel 1130 may be greater than that of a front surface of the support 1120. The area size and a shape of the cover panel 1130 may be an area size and a shape that may completely shield a space where the ironing module S is exposed in the detachment portion 380.

A width of the cover panel 1130 may be the same as a width of the support 1120 or a width of the open surface 1220, and a height of the cover panel 1130 may be greater than a height of the support 1120 and the same as a height of the open surface 1220.

A recessed portion 1150 that is recessed inward and an extendable portion handle 1140 disposed on the recessed portion 1150 may be disposed at an upper portion of the cover panel 1130.

The extendable portion 1100 may include a guide groove 1110 at a lower portion of the support 1120 to guide the support 1120 to slide in the front and rear direction without moving in the left and right direction.

The guide groove 1110 may be engaged with a rail disposed inside the storage body 1210 or a rail 3300 disposed in the base module 3000 and inserted into the storage body 1210. When the guide groove 1110 moves forward and rearward along the rail 3300, the entire extendable portion 1100 may be extended from or retracted via the open surface 1220.

The storage body 1210 may have an insertion hole defined in a lower portion of a rear surface thereof into which the rail 3300 may be inserted. In addition, the storage body 1210 may include an open hole through which the cable 1400 extending from the heating module 2000 may pass through the rear surface.

The insertion hole and the open hole may be integrally defined.

However, the steam iron 1300 may be prevented from being withdrawn or exposed via the insertion hole and the open hole. For example, the insertion hole and the open hole may be defined lower than the support 1120 or the steam iron 1300.

The heating module 2000 may include a heat generator 2100 that supplies heat and steam to the steam iron 1300. The heat generator 2100 may receive power, heat a wire, and transmit heat to the steam iron 1300 via the cable 1400, or heat water to generate steam and transmit steam to the steam iron 1300 via the cable 1400.

For example, the heat generator 2100 may be equipped as the steam generator that receives power and water to generate steam.

The steam generator 2100 may be equipped separately from the steam supply 800 seated in the machine room 300. The steam generator 2100 may receive water and power and heat water to generate steam.

In addition, the steam generator 2100 may supply steam up to the steam iron 1300, and generate steam of a higher pressure than the steam supply 800 such that steam supplied up to the steam iron 1300 may be sprayed onto the laundry.

The steam generator 2100 may be coupled with a connector 2800 that receives power and may include a pressure sensor that senses the pressure of steam generated inside.

The steam generator 2100 may be equipped as any component as long as it is able to receive water and heat steam. The steam generator 2100 may include a steam container forming an outer appearance thereof and a steam heater that is disposed inside the steam container and heats water.

In addition, the heating module 2000 may be connected to a high-pressure pump 2200 that increases a pressure inside the steam generator 2100 to induce the generation of high-pressure steam.

The heating module 2000, unlike the storage module 1000, may be prevented from being withdrawn from the machine room 300. That is, when the heating module 2000 is installed in the machine room 300, the heating module 2000 may be fixed inside the machine room 300. For example, the heating module 2000 may be mounted on and fixed on the base module 3000.

Entire components of the heating module 2000 may be positioned at the rear of the storage module 1000. As a result, the exposure of the storage module 1000 forward of the machine room 300 and the forward withdrawal and the rearward insertion of the steam iron 1300 from and into the machine room may not be hindered. In addition, the storage module 1000 may be prevented from being exposed rearward of the machine room 300.

The heating module 2000 may be mounted and fixed on the base module 3000 or the base 310. For the entire components of the heating module 2000 to be stably installed, an entirety of the heating module 2000 may be accommodated in a heating casing 2700. The heating casing 2700 may have an open surface in a front surface thereof through which the cable 1400 may pass, and may be formed in a box shape with both side surfaces and a top surface not exposed to the outside.

Most of the components of the heating module 2000 may be installed inside the heating casing 2700. Therefore, maintenance and repair of the heating module 2000 may be easy.

The base module 3000 may include a base panel 3200 disposed in parallel with the base 310, and a seating panel 3100 extended from the base panel 3200 and on which the storage module 1000 and the heating module 2000 are seated.

The base panel 3200 may be formed integrally with the base 310.

However, when the ironing module S is constructed as the module independent of the circulation duct 320, the base panel 3200 may be formed separately from the base 310.

The seating panel 3100 may fix the lower portions of the storage module 1000 and the heating module 2000, but space the storage module 1000 and the heating module 2000 apart from the base panel 3200 by a certain vertical dimension.

As a result, a space in which the water supply structure connected to the cable 1400 or the heating module 2000 to supply water to the heating module 2000 and the drainage structure to discharge water from the heating module 2000 may be installed between the storage module 1000, the heating module 2000, and the base panel 3200.

Furthermore, because the storage module 1000 and the heating module 2000 are disposed upward of the drainage structure because of the seating panel 3100, condensate or residual water generated in the storage module 1000 and the heating module 2000 may be guided to the drainage structure without a separate power member.

The seating panel 3100 may extend upward from both side surfaces of the base panel 3200.

The base module 3000 may be coupled with the rail 3300 that is coupled to an inner surface of the seating panel 3100 and extends the extendable portion 1100.

Figure 18:
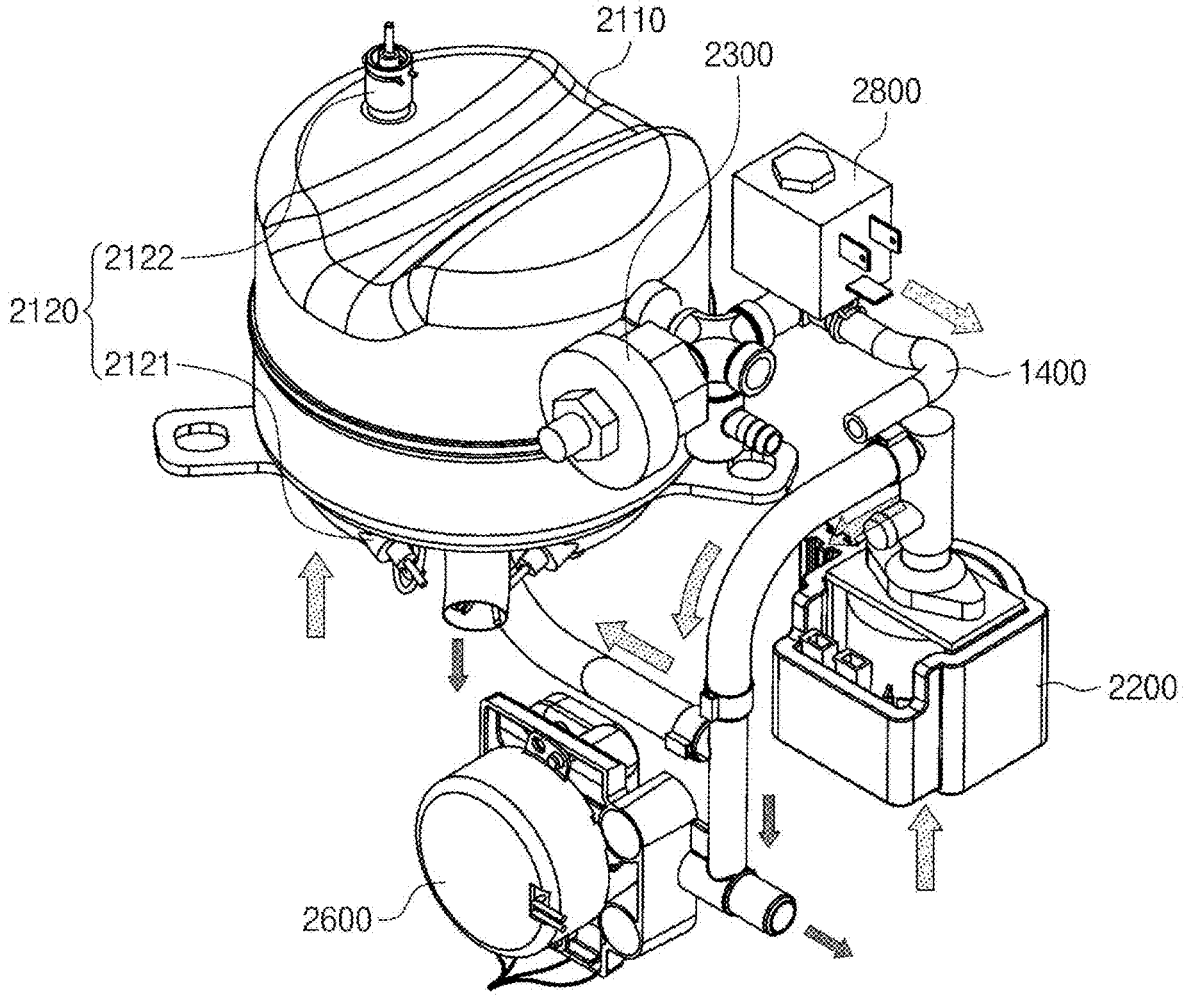
FIG. 18 shows a water supply and drainage structure of the heating module 2000.

FIG. 18 shows a water supply and drainage structure of the heating module 2000.

For the steam generator 2100 to generate steam and deliver steam to the steam iron 1300, water needs to be supplied.

To this end, the steam generator 2100 may include the high-pressure pump 2200 that is connected to the water source and supplies water to the steam generator 2100.

The high-pressure pump 2200 may be in communication with the water supply tank 301 and receive water from the water supply tank 301.

In one example, the high-pressure pump 2200 may receive water from a water source different from the water supply tank and supply water to the steam generator 2100.

In one example, the high-pressure pump 2200 may not simply supply water to the steam generator 2100, but may supply water while increasing the pressure inside the steam generator 2100. As a result, water may be heated while the pressure inside the steam generator 2100 is higher than an atmospheric pressure, thereby generating high-pressure steam.

The steam generator 2100 may include the pressure sensor 2300 that measures the internal pressure.

The pressure sensor 2300 may be in communication with the exit 2150 extending from the body 2110, and a steam valve 2800 that opens and closes the exit 2150 may be coupled.

The steam valve 2800 may be controlled by a control panel of the ironing module S. the opening and closing of the steam valve 2800 may be controlled based on a pressure and a temperature inside the body 2110 or a pressure and a temperature of the exit 2150.

The cable 1400 may have one end connected to the steam valve 2800 and the other end connected to the steam iron 1300.

When the steam valve 2800 is opened, steam generated by the steam generator 2100 may be supplied to the steam iron 1300, and when the steam valve 2800 is closed, the supply of both water and steam to the steam iron 1300 may be blocked.

The pressure sensor 2300 may induce the high-pressure pump 2200 to be operated more when the pressure of the steam generator 2100 is lower than a reference pressure, and may induce water or steam inside the steam generator 2100 to be discharged when the pressure of the steam generator 2100 is higher than the reference pressure.

For example, the reference pressure may be set to be 1 bar to 3 bar higher than the atmospheric pressure.

The steam generator 2100 may be seated on the base module 3000 and fixed using a fastening member or the like, and the high-pressure pump 2200 may also be seated on the base module 3000.

The heating module 2000 may include a pump connection pipe 2540 that connects the high-pressure pump 2200 with the steam generator 2100. The pump connection pipe 2540 may be made of a flexible material like a rubber hose or the like and may guide high-pressure water into the steam generator 2100.

The high-pressure pump 2200 may include a pump discharge pipe 2210 that receives and discharges water, and a pump supply pipe 2211 that extends from the pump discharge pipe 2210 and supplies water to the pump connection pipe 2540.

The pump supply pipe 2211 may be branched from the pump discharge pipe 2210 so as to effectively transfer water of various pressures or high-pressure water, and the pump connection pipe 2540 may also be formed in a shape of a single pipe at one end, but may be formed as a plurality of branch pipes at the other end so as to be connected to the pump supply pipe 2211.

The water supply structure 2500 may include a water supply connection pipe 2510 that supplies water from the water source to the steam generator 2100 or the high-pressure pump 2200, and a branch supply pipe 2530 that supplies the water from the high-pressure pump 2200 to the steam generator 2100.

In one example, a drainage apparatus 2400 that discharges water inside the steam generator 2100 when the steam generator 2100 stops operating or when steam generated from the steam generator 2100 condenses to generate water may be included.

The drainage apparatus 2400 may be equipped as a pump or as a simple valve. The drainage apparatus 2400 may be disposed under the steam generator 2100 and receive water from a drainage port 2160 of the steam generator 2100.

The drainage structure 2600 may discharge water condensed in the steam generator 2100 or collected in the drainage apparatus 2400.

The drainage structure 2600 may include a drainage connection pipe 2610 extending from the drainage apparatus 2400 to the drainage port 2160, and an inflow pipe 2620 coupled to the drainage connection pipe 2610 to guide water discharged from the drainage apparatus 2400 to the drainage tank 302.

The drainage apparatus 2400 may be connected to both the water supply structure 2500 and the drainage structure 2600. As a result, the structure of supplying or discharging water to or from the steam generator 2100 is unified, simplifying a flow channel and saving space.

In this case, water supplied to an apparatus connection pipe 2520 may be delivered to the drainage apparatus 2400, and the drainage connection pipe 2610 may be in communication with the apparatus connection pipe 2520.

The drainage apparatus 2400 may be controlled to selectively open at least one of the drainage connection pipe 2610 and the apparatus connection pipe 2520. When the drainage apparatus 2400 closes at least one of the drainage connection pipe 2610 and the apparatus connection pipe 2520, water supplied from the pump connection pipe 2540 may be supplied to the steam generator 2100 through the apparatus connection pipe 2520.

When the drainage apparatus 2400 opens both the drainage connection pipe 2610 and the apparatus connection pipe 2520, water collected or condensed in the steam generator 2100 may be completely discharged via the drainage connection pipe 2610. Accordingly, the apparatus connection pipe 2520 may serve as both a flow channel for supplying water to the steam generator 2100 and a flow channel for discharging water from the steam generator 2100.

The drainage apparatus 2400 may be controlled by an independent controller to be described below.

Figure 19:
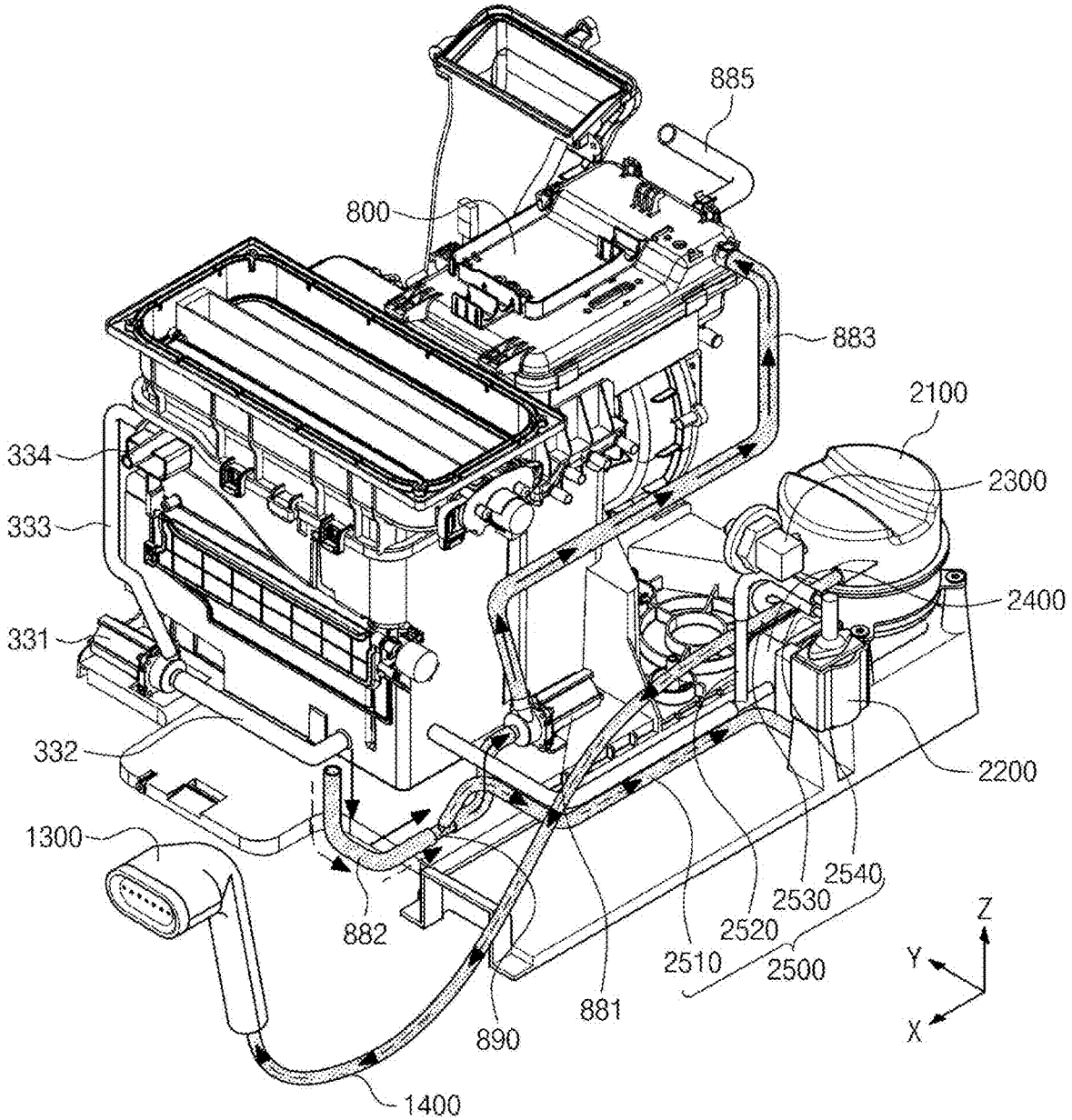
FIG. 19 shows a structure in which the water supply structure and the water supply are in communication with each other.

FIG. 19 shows a structure in which the water supply structure and the water supply are in communication with each other.

The ironing module S may be installed independently of and separately from the structure of the machine room 300, but may be in communication with the water supply 880 disposed in the machine room 300.

As a result, the ironing module S may receive water from the water supply tank 301. Accordingly, the ironing module S being connected to a separate water source or placing an additional water supply tank may be omitted. In addition, the laundry treating apparatus may supply steam to both the inside of the inner casing 200 and the steam iron 1300 via the single water supply tank 301.

In one example, when the steam supply 800 is operated, the steam generator 2100 is controlled not to be operated, and when the steam generator 2100 is operated, the steam supply 800 is controlled not to be operated.

To this end, the laundry treating apparatus of the present disclosure may further include a switching valve 890 that selectively supplies water contained in the water supply tank 301 to the steam supply 800 and the steam generator 2100.

The switching valve 890 may be disposed between the water supply pump 881 and the supply pipe 882 and may be controlled by a main controller 700.

The switching valve 890 may be equipped as a three-way valve.

When at least one of the closing of the door and the operation of the refreshing module T occurs, the switching valve 890 may be controlled to allow the water supply tank 301 and the water supply pump 881 to be in communication with each other and to block the communication between the water supply tank 301 and the water supply structure 2500.

When at least one of the opening of the door and termination of the operation of the refreshing module T occurs, the switching valve 890 may be controlled to block the communication between the water supply tank 301 and the water supply pump 881 and to allow the water supply tank 301 and the water supply structure 2500 to be in communication with each other.

When the switching valve 890 allows the water supply tank 301 and the water supply structure 2500 to be in communication with each other, the water supply connection pipe 2510 may receive water from the water supply tank 301 and transfer water to the high-pressure pump 2200.

The water supply connection pipe 2510 may have one end connected to the water supply 2501 and the other end connected to the high-pressure pump 2200.

In one example, the switching valve 890 may be equipped as a simple T-shaped pipe instead of the valve that changes the flow channel. In this case, when the water supply pump 881 is not operated and only the high-pressure pump 2200 is operated, water in the water supply tank 301 may be introduced into the high-pressure pump 2200 by a negative pressure. Water introduced into the high-pressure pump 2200 may be introduced into the steam generator 2100 via the pump connection pipe 2540 or the like.

In addition, when the water supply pump 881 is operated and the high-pressure pump 2200 is not operated, water in the water supply tank 301 may be supplied to the water supply pump 881 by the negative pressure, flow along the connection pipe 833, and be supplied to the steam supply 800.

Regardless of the configuration of the switching valve 890, when the steam generator 2100 is operated and steam is generated, steam may be transferred to the steam iron 1300 along the cable 1400 and sprayed to the outside of the steam iron 1300.

When the steam nozzle 900 is disposed separately, water supplied via the water supply pump 881 may be supplied to the steam nozzle 900 and then to the steam supply 800.

As a result, the laundry treating apparatus of the present disclosure may supply water contained in the water supply tank 301 to both the steam supply 800 and the steam generator 2100. Therefore, installation of a separate water supply tank for the ironing module S may be omitted.

Figure 20:
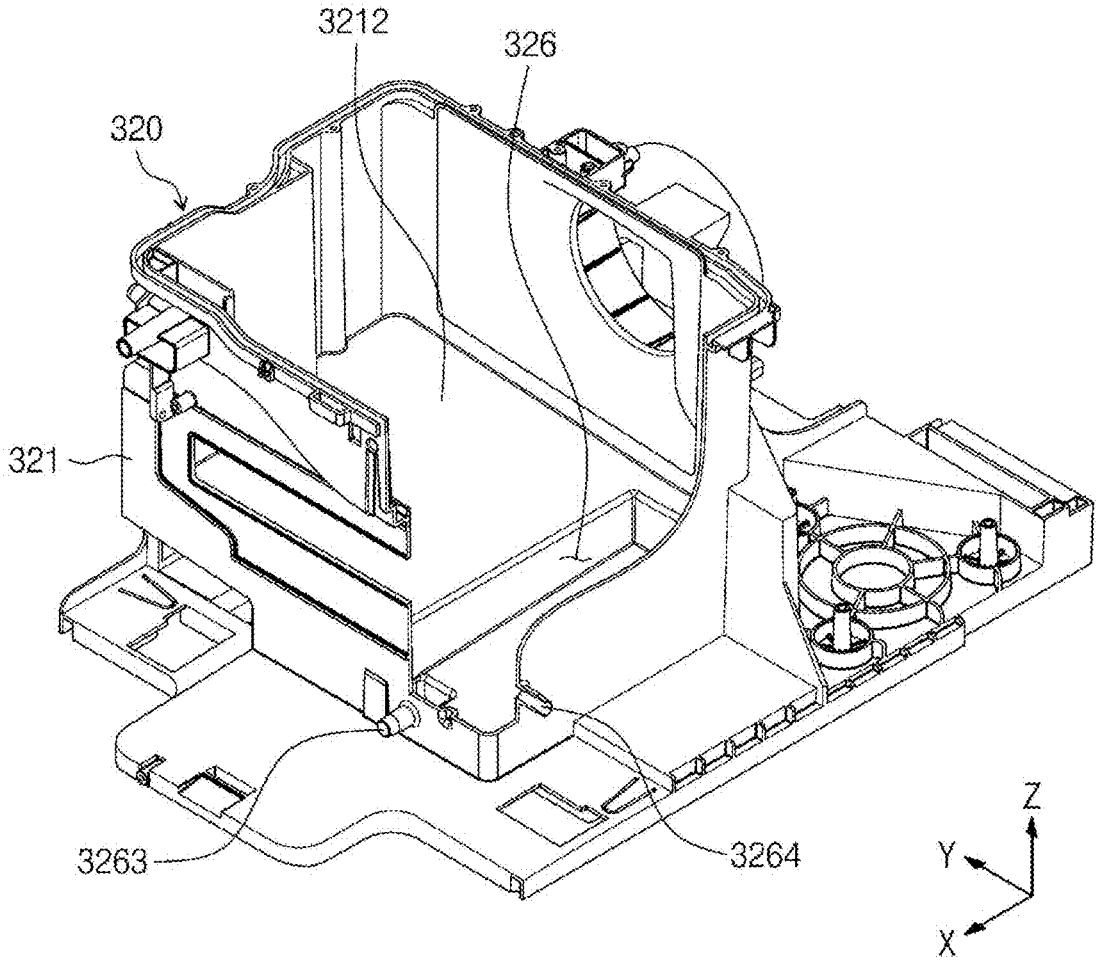
FIG. 20 shows a prerequisite structure in which the drainage structure and the drainage may be in communication with each other.

FIG. 20 shows a prerequisite structure in which the drainage structure and the drainage may be in communication with each other.

The circulation duct 320 may further include an inlet pipe 3264 that guides water discharged from the drainage structure 2600 to the reservoir 326.

A direction in which the inlet pipe 3264 is directed and a direction in which the guide pipe 3263 is directed may be different from each other.

For example, the guide pipe 3263 may be formed on the front surface of the circulation duct 320, and the inlet pipe 3264 may be formed on a left side surface or a right side surface of the circulation duct 320.

The inlet pipe 3264 may be disposed in an area corresponding to a side surface of the reservoir 326 in the side surface of the circulation duct 320.

The inlet pipe 3264 may allow the inside of the reservoir 326 and the outside of the circulation duct 320 to be in communication with each other, and may protrude outward from the side surface of the circulation duct 320.

The inlet pipe 3264 may be installed at a vertical level higher than that of a bottom surface of the reservoir 326 or the guide pipe 3263.

When the drainage structure 2600 discharges water to the inlet pipe 3264, water may be collected in the reservoir 326 and discharged via the guide pipe 3263 to be in communication with the drainage 330.

Therefore, a separate drainage tank for the ironing module S may be omitted.

Figure 21:
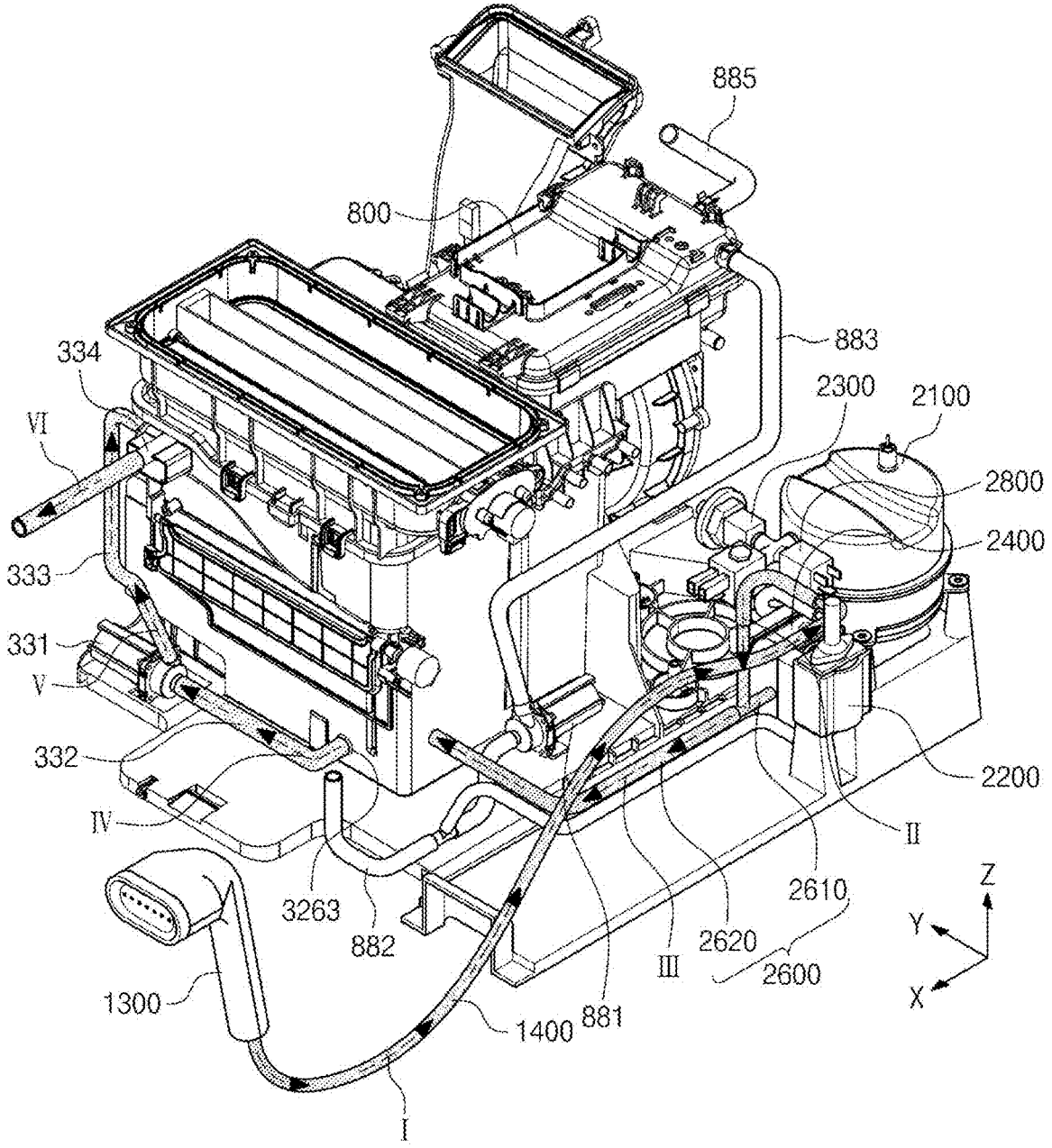
FIG. 21 shows a structure in which the drainage structure and the drainage are in communication with each other.

FIG. 21 shows a structure in which the drainage structure and the drainage are in communication with each other.

The ironing module S may be installed independently of and separately from the structure of the machine room 300, but may be in communication with the drainage 330 of the refreshing module T via the circulation duct 320.

As a result, the ironing module S may discharge residual water into the drainage tank 302. Therefore, a structure in which the ironing module S includes an additional drainage tank 302 or is connected to a separate sewer may be omitted.

The laundry treating apparatus of the present disclosure may collect both residual water collected in the circulation duct 320 and residual water collected in the ironing module S with the single drainage tank 302. The user may discharge both water collected in the circulation duct 320 and the ironing module S by dumping water in the drainage tank 302.

The drainage structure 2600 may be in communication with the drainage 330 via the circulation duct 320.

The drainage structure 2600 may include the drainage connection pipe 2610 connected to the drainage apparatus 2400, and the inflow pipe 2620 connected to the drainage connection pipe 2610 and in communication with the drainage 330. The inflow pipe 2620 may be connected to the inlet pipe 3264.

Water condensed in the steam generator 2100 and residual water may be collected in the drainage apparatus 2400 (direction II). Water condensed in the steam iron 1300 may flow along the cable 1400 and be collected in the drainage apparatus 2400 via the steam generator 2100 (direction I). Water collected in the drainage apparatus 2400 may be connected to the inlet pipe 3264 along the inflow pipe 2620. Water may be collected in the drainage tank 302 (direction III). That is, when the drainage pump 331 is operated, water collected in the drainage apparatus 2400 may be collected in the drainage tank 302 by the negative pressure.

The inflow pipe 2620 may be in communication with the inside of the circulation duct 320.

As a result, all of water collected in the drainage apparatus 2400 may be collected inside the circulation duct 320 and then flow to the drainage pump 331 via the guide pipe 3263. Even when an amount of water collected in the drainage apparatus 2400 is large or an amount of water discharged via the drainage apparatus 2400 is large, water may be collected inside the circulation duct 320, thereby preventing water from overflowing out of the machine room 300.

In one example, the drainage apparatus 2400 may be mounted on the base module 3000 and positioned at a vertical level higher than that of a distal end of the inflow pipe 2620. Accordingly, even when the drainage apparatus 2400 does not generate any special power, water collected in the drainage apparatus 2400 may be collected in the reservoir 326 along the inflow pipe 2620.

When the drainage pump 331 is operated, water collected in the reservoir 326 may be stored in the drainage tank 302.

Figure 22:
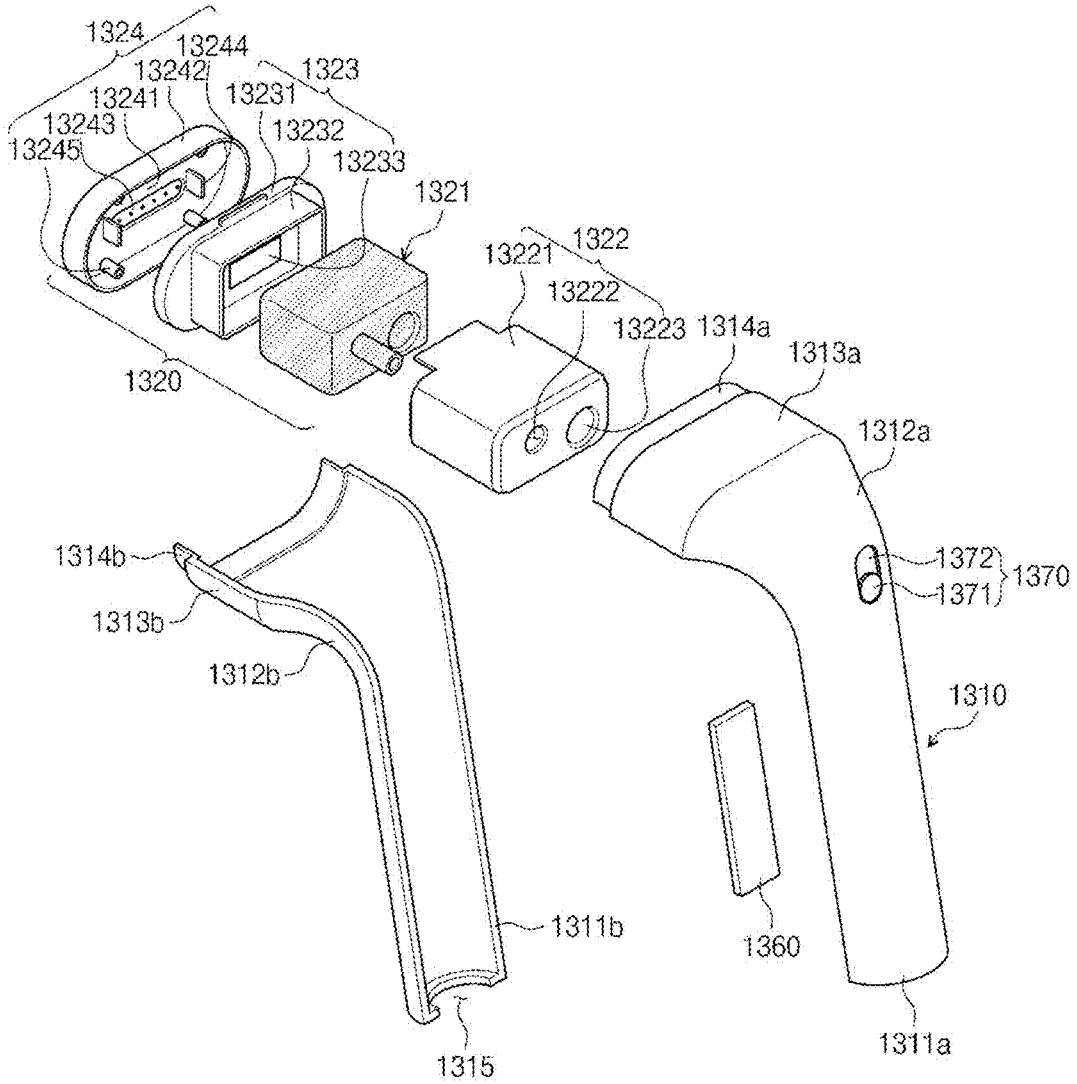
FIG. 22 shows a structure of the steam iron.

FIG. 22 shows a structure of the steam iron.

The steam iron 1300 of the present disclosure may include a gripping portion 1310 connected to the cable 1400 and constructed to be gripped by the user.

The gripping portion 1310 may spray and supply at least one of water and steam to the surface of the laundry.

The gripping portion 1310 may include a handle 1311 that may support a weight of the steam iron 1300, and an extended portion 1313 extended from an upper end of the handle 1311.

The gripping portion 1310 may have an installation space defined therein through which steam may pass and in which various components may be installed, and at least one of steam and heat may be discharged via a distal end of the gripping portion 1310.

The gripping portion 1310 may have a length greater than a width or a thickness, thereby preventing a user's body from being damaged by steam and heat discharged from the distal end of the gripping portion 1310.

The gripping portion 1310 may include the handle 1311 formed in a pipe shape or the like to provide an area that a user's hand may grip, a bent portion 1312 bent from the handle 1311, and the extended portion 1313 that extends from the bent portion 1312 to a distal end.

The handle 1311 may be formed in a cylindrical shape to accommodate the cable 1400 therein and may have a length greater than a diameter. As a result, a space that the user may grip may be secured.

The bent portion 1312 may be bent within 90 degrees at a distal end of the handle 1311. Because of the bent portion 1312, at least one of steam and heat flowing along the handle 1311 may easily encounter the laundry.

The extended portion 1313 may have the greatest cross-sectional area compared to the bent portion 1312 and the handle 1311. As a result, at least one of steam and heat may be induced to be supplied to a wide area.

A space in which a heating apparatus or the like that increases a temperature of supplied steam and heat may be accommodated may be defined in the extended portion 1313.

The gripping portion 1310 may be formed in two pieces to facilitate installation and accommodation of internal components thereof.

For example, the gripping portion 1310 may include a lower gripping portion 1310*b* that may form a bottom surface and a portion of both side surfaces of the gripping portion 1310, and an upper gripping portion 1310*a* that may form a top surface and a remaining portion of both side surfaces of the gripping portion 1310.

The gripping portion 1310 may further include a converging portion 1314 that extends further from the extended portion 1313 to the distal end, but has a smaller cross-sectional area than the extended portion 1313. The converging portion 1314 may prevent the internal components of the gripping portion from being arbitrarily discharged to the outside.

The converging portion 1314 may have a hollow defined therein, thereby allowing at least one of steam and heat transferred up to the extended portion 1313 to flow to the outside of the steam iron 1300.

The steam iron 1300 may include a sprayer 1320 that is supported in the gripping portion 1310 and discharges water and steam supplied from the steam generator 2100.

The sprayer 1320 may include a chamber portion 1321 that is coupled to the cable 1400 to receive and spray water and steam, an insulating accommodating portion 1322 that prevents heat generated in the chamber from being transferred to the gripping portion 1310, a fixing bracket 1323 that is coupled to a front side of the chamber portion 1321 and prevents the chamber portion 1321 from being deviated forward of the gripping portion 1310, and a sprayer cover 1324 that is disposed in front of the fixing bracket 1323 and shields the distal end of the gripping portion 1310.

The chamber portion 1321 may provide a space for storing water and steam transferred from the cable 1400 and may transfer the steam to the outside of the steam iron 1300.

The chamber portion 1321 may be formed in a casing shape that accommodates steam or water supplied from the steam generator 2100.

As a result, even when steam is condensed into water in the sprayer 1320, water may be reheated and sprayed as steam, and even before steam is condensed into water, steam may be reheated and prevented from being condensed into water.

The sprayer cover 1324 may form a distal end of the steam iron 1300.

The sprayer cover 1324 may include a coupling surface 13241 coupled to the distal end of the gripping portion 1310, an exposed surface 13242 extending from the coupling surface 13241 to form a distal end surface of the steam iron 1300, and a spray hole 13243 extending through the exposed surface 13242 to spray steam to the outside.

The sprayer cover 1324 may include a fixing fastener 13244 that may be fixed by being coupled to the gripping portion 1310 or the internal component thereof, and may include guide ribs 13245 disposed on both sides of the spray hole 13243 to guide the flow of the steam.

The exposed surface 13242 may be formed flat so as to be in contact with the surface of the laundry and may transfer steam and heat generated in the chamber portion 1321 to the surface of the laundry.

The steam iron 1300 of the present disclosure may further include the fixing bracket 1323 that fixes the chamber portion 1321 at the distal end of the gripping portion 1310.

The fixing bracket 1323 may include an accommodating circumferential portion 13231 that accommodates therein a front surface of the chamber portion 1321, a transfer hole 13232 that is defined inside the accommodating circumferential portion and transmits at least one of steam and heat discharged from the chamber portion 1321 to the sprayer cover 1324, and an expansion body 13233 that expands from the accommodating circumferential portion 13231 and is in contact with the coupling surface.

The steam iron 1300 of the present disclosure may include the insulating accommodating portion 1322 that accommodates the chamber portion 1321 therein and insulates the chamber portion 1321.

The insulating accommodating portion 1322 may include an accommodating body 13221 that accommodates the chamber therein, a passage hole 13222 that extends through a rear surface of the accommodating body 13221 and allows steam supplied from the cable 1400 to pass therethrough, and a power hole 13223 through which a power line extended from the cable 1400 passes.

The accommodating body 13221 may accommodate all surfaces except a front surface of the sprayer 1320 therein, and may be made of an insulating material.

As a result, the chamber portion 1321 may be prevented from being cooled, thereby preventing steam from condensing inside the chamber portion 1321 or preventing reduction of a thermal efficiency of the steam iron 1300.

The gripping portion 1310 may further include a steamer panel 1360 that may control on/off of the ironing module S and a spray amount of the ironing module S. The steamer panel 1360 may be equipped as a PCB panel.

The steamer panel 1360 may control at least one of the steam generator 2100, the pressure sensor 2300, the temperature sensor 2120, the water supply structure, the drainage structure, and the steam valve 2800, and may perform an arbitrary mode in which the ironing module S supplies steam and heat to the laundry.

The mode may include a first mode that sprays a first amount of steam onto the laundry, a second mode that sprays a second amount of steam greater than the first amount, and a third mode that sprays a third amount of steam greater than the second amount.

In one example, the chamber portion 1321 of the present disclosure may not only receive and discharge steam, but also reheat water and steam supplied from the cable 1400.

Specifically, the steam generator 2100 heats water to generate and discharges steam.

However, the steam generator 2100 and the steam iron 1300 are spaced apart from each other by a length of the cable 1400, and during the process in which steam passes through the cable 1400, steam is able to at least partially condense into water because of heat exchange with the outside.

In addition, even when the steam generator 2100 generates and discharges high-pressure steam, because the internal pressure of the steam iron 1300 corresponds to the atmospheric pressure, the pressure may decrease during the process of high-pressure steam flowing between the cable 1400 and the steam iron 1300, causing water to condense.

For example, even when steam with a temperature and a pressure respectively corresponding to 150 degrees Celsius and 4 bar is discharged from the steam generator 2100, steam may be changed into steam with a temperature and a pressure of 100 degrees Celsius and 1 atm while being transmitted to the cable 1400 and the steam iron 1300, and further may be changed into condensate with a temperature equal to or lower than 100 degrees Celsius.

In addition, even when only steam is normally supplied up to the steam iron 1300, steam may be condensed into water while passing through the gripping portion 1310 and the sprayer 1320 of the steam iron 1300.

In this case, water may be discharged from the steam iron 1300, causing the laundry to become wet.

To prevent such problem, the ironing module S of the present disclosure may reheat at least one of water and steam transmitted via the cable 1400 inside the steam iron 1300.

Because the gripping portion 1310 is a portion that comes into contact with the user's body, the ironing module S of the present disclosure may be constructed such that the sprayer 1320 is heated to reheat at least one of water and steam supplied from the cable 1400.

As a result, even when water is supplied from the cable 1400 or steam is partially condensed while passing through the sprayer 1320, water or steam may be reheated in the sprayer 1320 and entirely sprayed out of the steam iron 1300 in a steam state.

In addition, the steam iron 1300 of the present disclosure may have a separate space for collecting condensate inside. Therefore, even when water condenses inside the steam iron 1300 or condensed water is delivered to the steam iron 1300, water may be prevented from being discharged as it is to the outside of the steam iron 1300.

Additionally, the steam iron 1300 of the present disclosure may reheat the collected water in the sprayer 1320 to regenerate steam and then discharge steam.

In the steam iron 1300 of the present disclosure, at least some components of the sprayer 1320 may reheat water and steam.

For example, because the chamber portion 1321 is a component that is in direct communication with the cable 1400, the chamber portion 1321 may be able to heat water and steam. In addition, all other components of the sprayer 1320 may be made of an insulating material or a material having a high specific heat, so that the user may be prevented from being burned by the chamber portion 1321 or water may be prevented from condensing inside the chamber portion 1321.

The gripping portion 1310 may be equipped with an operation input unit 1370 that receives a command to control the ironing module S.

The operation input unit 1370 may include a power unit 1371 that determines on/off of the chamber portion 1321 and the steam generator 2100, and a selection unit 1372 that selects an arbitrary mode that may adjust a heating intensity of the chamber portion 1321 and the steam generator 2100 to adjust the spray amount of the ironing module S.

The power unit 1371 and the selection unit 1372 may be equipped as any component as long as they are able to receive an input of the user, such as a button type, a slide type, or a touch type.

Figure 23:
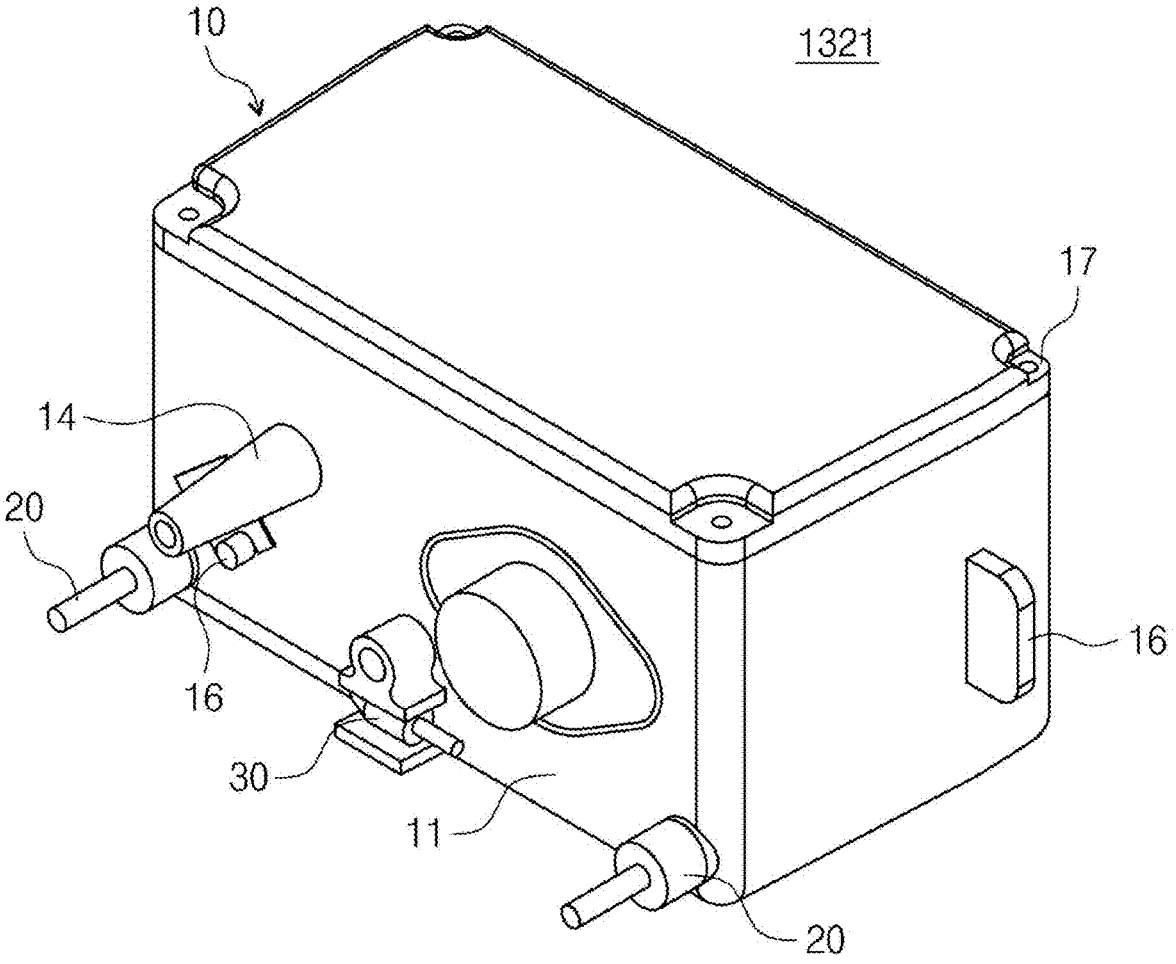
FIG. 23 shows a structural embodiment of the chamber.

FIG. 23 shows a structural embodiment of the chamber.

The chamber portion 1321 may include a housing 10 that provides a space for storing steam and water. The housing 10 may be entirely made of a metal material, and may be formed in any shape as long as it is able to have the space inside.

For example, the housing 10 may be formed in a rectangular parallelepiped shape, and may have a height smaller than a width. As a result, a height at which steam rises from the housing 10 may be reduced, so that condensation of steam may be minimized.

Figure 24:
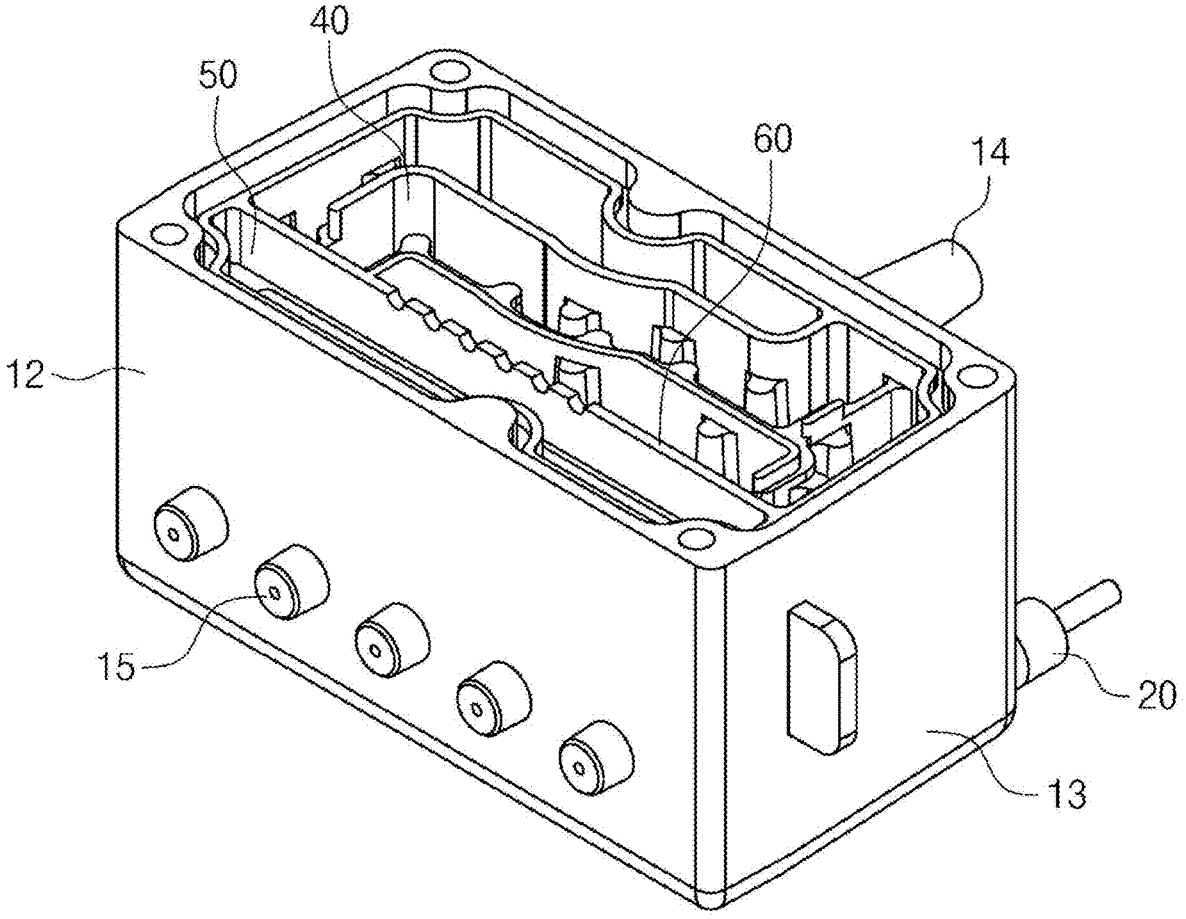
FIG. 24 shows an embodiment of an internal structure of the chamber.

A sprayer 15 that sprays steam may be disposed on a front surface 12 of the housing 10 (see FIG. 24).

Therefore, when an inlet 14 through which water and steam may be supplied is formed on a rear surface 11 of the housing 10, a flow direction of steam and water and a direction in which steam is sprayed may coincide with each other, same, so that generation of residual water inside the housing 10 may be minimized.

The inlet 14 may be detachably coupled to the cable 1400.

The inlet 14 may be inserted into the cable 1400 or may be formed in a pipe shape that accommodates the cable 1400 therein. As a result, water and steam may be prevented from leaking out via the inlet 14.

The housing 10 may have a width greater than a length in the front and rear direction. That is, a length of the rear surface 11 and the front surface 12 of the housing 10 may be greater than a length of a side surface 13. The housing 10 may induce water and steam to flow rearward in the housing 10, but to flow in a zigzag manner to both side surfaces, so that water and steam may be induced to be heated for a longer time. In addition, the housing 10 may be prevented from being unnecessarily long, thereby preventing a center of gravity of the steam iron 1300 from being away from the handle area.

The chamber portion 1321 may further include a chamber heater 20 coupled to the housing 10 to heat the housing 10. The chamber heater 20 may be connected to a power line accommodated in the cable 1400.

The chamber heater 20 may heat an entire inside of the housing 10.

The chamber portion 1321 may further include a fuse 30 that may prevent overheating of the chamber heater 20 or the housing 10 or block current leakage.

In addition, the chamber portion 1321 may further include a sensor 80 that may sense a temperature of the housing 10.

Both the fuse 30 and the sensor 80 may be connected to the power line built into the cable 1400 or may be connected to the steamer panel 1360.

FIG. 24 shows an embodiment of an internal structure of the chamber.

The housing 10 may have an open top surface and the storage space defined therein.

The inlet 14 may be disposed on a surface opposite to a surface of the sprayer 15 such that water and steam may be in contact with or stay in the housing 10 for the longest time.

The chamber portion 1321 may have the sprayer 15 on the front surface 12 of the housing 10, and have the inlet 14 on the rear surface 11.

The housing 10 may be formed with an empty space inside. That is, formation of a surface of the housing 10 and a shape of an inner wall of the housing 10 may correspond to each other.

In addition, the housing 10 may further include a heating partition wall 60 that reheats water and steam supplied from the cable 1400 therein.

The heating partition wall 60 may be in contact with water and steam, and may prevent water and steam from being directly discharged to the sprayer 15.

The sprayer 15 and the inlet 14 may be partitioned from each other by the heating partition wall 60.

Specifically, the inside of the housing 10 may be partitioned by the heating partition wall 60 into a heating chamber 40 in which at least one of water and steam introduced from the inlet 14 flows and is heated, and a spray chamber 50 in which steam heated in the heating chamber 40 is prepared to be discharged to a spray nozzle 15.

The heating chamber 40 may be formed with a flow channel through which water and steam flow, and the spray chamber 50 may be formed as a space that faces the sprayer 15 and is able to temporarily store at least one of steam and water.

The heating chamber 40 may have the plurality of heating partition walls 60 additionally disposed therein, and may have greater area size and volume than the spray chamber 50.

As a result, water and steam introduced from the inlet 14 may be heated for a longer period of time and passed to the spray chamber 50.

In addition, the spray chamber 50 may also be reheated because of the inner wall of the housing 10 and the heating partition wall 60. Therefore, water and steam introduced into the spray chamber 50, or condensed water, may all be vaporized into steam and discharged via the sprayer 15.

Accordingly, even when water is generated in or introduced from any area of the ironing module S, water may be completely vaporized into steam in the chamber portion 1321 and discharged via the sprayer 15. As a result, water may be prevented from leaking out of the steam iron 1300.

Figure 25:
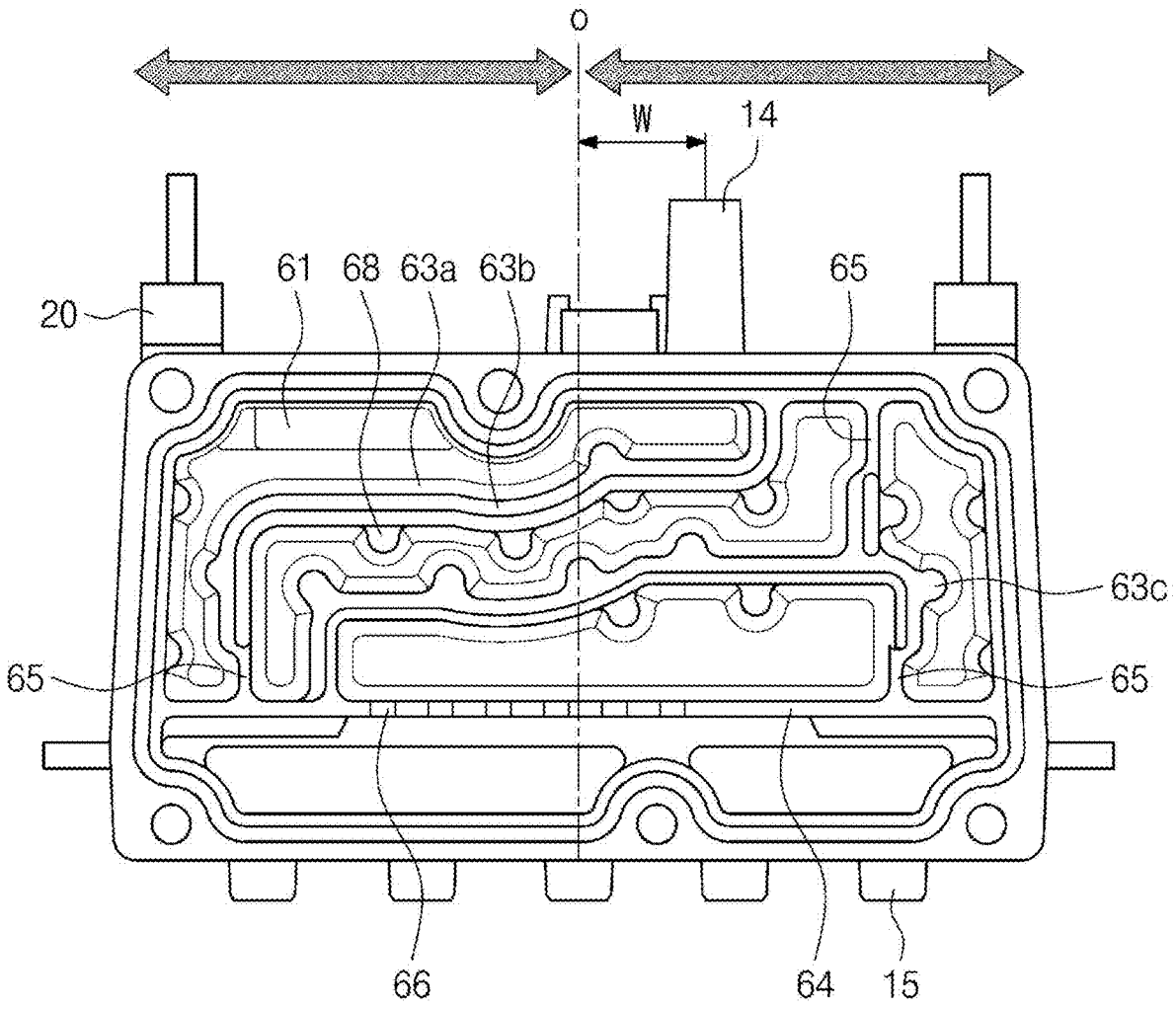
FIG. 25 shows an internal structure of the chamber in detail.

FIG. 25 shows an internal structure of the chamber in detail.

The heating partition wall 60 may include a blocking partition wall 64 that is disposed to extend between the sprayer 15 and the inlet 14 to divide the inside of the housing 10 into the heating chamber 40 that is in communication with the inlet 14 and the spray chamber 50 that is in communication with the sprayer 15.

In addition, when the heating partition wall 60 is the component that reheats at least one of water and steam introduced into the housing 10, the heating partition wall 60 may include an inner wall 61 of the housing 10.

That is, the inner wall 61 of the housing 10, as a component that defines the storage space inside the housing 10, may be entirely heated by a steam heater 20 to heat at least one of water and steam. Therefore, both water and steam introduced into the inlet 14 may be heated by being in contact with the heating partition wall 60 including the inner wall 61 and may be completely vaporized into high-temperature steam.

The blocking partition wall 64 may be disposed to face the front surface 12 and the rear surface 11 of the housing 10. The blocking partition wall 64 may connect both side surfaces of the housing 10 to each other. The blocking partition wall 64 may have a vertical dimension equal to that of the housing 10.

Water and steam introduced into the inlet 14 may be heated while flowing to the blocking partition wall 64. As a result, an amount of water reaching the blocking partition wall 64 may be minimized and an amount of steam may be maximized.

The blocking partition wall 64 may be disposed closer to the sprayer 15 than to the inlet 14. As a result, the heating chamber 40 may be formed wider than the spray chamber 50, and water and steam supplied from the cable 1400 may be heated for a longer time.

The heating partition wall 60 may further include a guide nozzle 66 disposed on the blocking partition wall 64 to allow water and steam supplied to the heating chamber 40 to flow to the spray chamber 50.

The guide nozzle 66 may extend through the blocking partition wall 64.

The guide nozzle 66 may extend through a portion of a top surface of the blocking partition wall 64, so that the blocking partition wall 64 may be formed in a shape in which a portion of an upper end thereof is recessed downward.

As a result, water that reaches the blocking partition wall 64 or is condensed is not able to pass over the blocking partition wall 64, and only steam is able to pass through the guide nozzle 66 and flow to the spray chamber 50.

The sprayer 15 is positioned upward of a bottom surface of the spray chamber 50. That is, the spray chamber 50 has an area that is positioned downward of the sprayer 15. Accordingly, the spray chamber 50 may accommodate therein steam that has passed through the guide nozzle 66 but has not been discharged to the sprayer 15.

In the spray chamber 50, steam may be sequentially discharged to the sprayer 15, and water condensed in such process may be collected in an area positioned downward of the sprayer 15. In this regard, collected water may be reheated in the spray chamber 50, vaporized into steam again, and discharged to the sprayer 15.

The heating partition wall 60 may include a guiding partition wall 63 that extends the flow channel through which steam and water flow inside the heating chamber 40. The guiding partition wall 63 may increase a surface area inside the heating chamber 40. As a result, the guiding partition wall 63 may heat water and steam by itself, and increase a time during which water and steam remain in the heating chamber 40.

The guiding partition wall 63 may guide water and steam introduced from the inlet 14 in a direction different from a direction toward the sprayer 15.

The guiding partition wall 63 may include a plurality of guiding partition walls that are disposed to be spaced apart from each other to form the flow channel through which water and steam flow.

The guiding partition wall 63 may have an area that spans between the inlet 14 and the sprayer 15 or in a width direction (a direction of both side surfaces) of the housing 10 longer than an area that extends from the inlet 14 toward the sprayer 15.

The guiding partition wall 63 may include a first guiding partition wall **63*a* that guides water introduced into the inlet 14 to an inner wall 61 of one side surface of the housing 10 rather than in the direction toward the sprayer 15, and a second guiding partition wall 63*b* that is spaced apart from or extended from the first guiding partition wall and guides water and steam flowing along the first guiding partition wall to an inner wall 61 of the other side surface of the housing 10**.

The second guiding partition wall may guide water and steam directly to the blocking partition wall 64.

Alternatively, the guiding partition wall 63 may include a third guiding partition wall **63*c* that is spaced apart from or extended from the second guiding partition wall and guides water and steam flowing along the second guiding partition wall to the guide nozzle 66 of the blocking partition wall 64**.

When possible, the guiding partition wall 63 may include a greater number of guiding partition walls.

The sprayers 15 may be evenly arranged along a width direction of the front surface of the housing 10 to evenly spray steam forward of the steam iron 1300. However, the inlet 14 may be disposed to be biased to one of both sides on the rear surface of the housing 10 to allow more water and steam to come into contact with the guiding partition wall 63.

That is, the inlet 14 may be disposed to be biased to one side by a spacing width w from a rear surface center o of the housing 10. The first guiding partition wall **63*a* may extend inward of the housing 10 from a portion that is spaced apart from the rear surface center o in the rear surface inner wall of the housing 10** by a distance greater than the spacing width w.

Because of the guiding partition wall 63, water and steam introduced into the inlet 14 may flow toward the sprayer 15 or the blocking partition wall 64 and be continuously heated while flowing to both sides of the housing 10 at least once.

The guiding partition walls 63 may have a portion where they are connected to each other. The portion where the guiding partition walls 63 are in contact with each other may have a step formed at upper ends of the guiding partition walls 63 or a passage 65 that extends through the guiding partition walls 63.

The passage 65 may be defined at the upper end of the guiding partition wall 63, or may be defined closer to the upper end than a lower end of the guiding partition wall 63. As a result, only heated steam may pass through the passage 65, and condensed water may remain in an upstream area of the passage 65 and be heated into steam.

The heating partition wall 60 may further include a plurality of protrusions 68 that protrude from the guiding partition wall 63 and are able to come into contact with steam and water flowing along the guiding partition wall 63. The protrusions 68 may be formed in a rib shape or a curved column shape to produce an effect of narrowing the flow channel between the guiding partition walls 63. As a result, an amount of water and steam flowing without being in contact with the guiding partition wall 63 may be reduced, and a contact area of the guiding partition wall 63 may be further increased.

Figure 26:
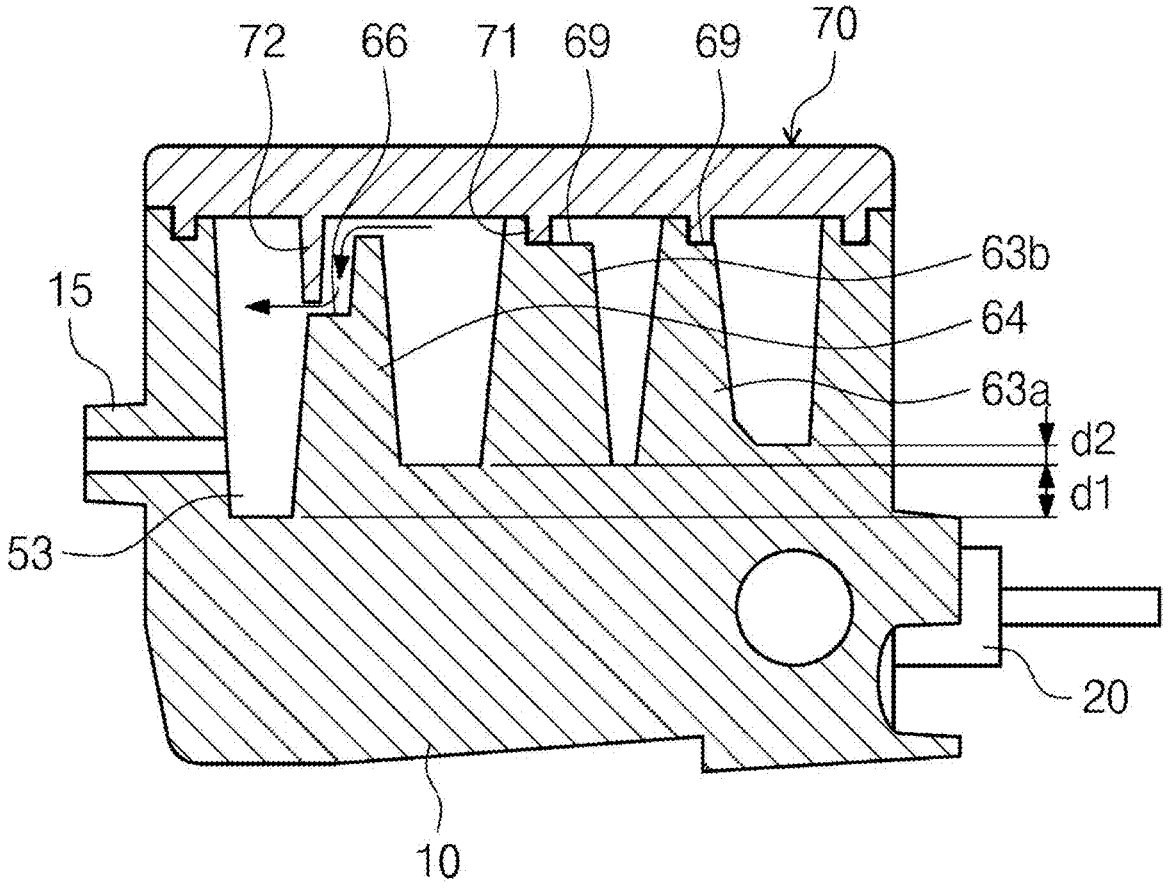
FIG. 26 shows a cross-section of the chamber.

FIG. 26 shows a cross-section of the chamber.

The chamber portion 1321 may further include a cover 70 that shields an upper portion of the housing 10.

The chamber portion 1321 may be formed in two-piece, including the housing 10 and the cover 70. As a result, the blocking partition wall, the guiding partition wall, the guide nozzle, and the like may be easily cast inside the housing 10.

Upper ends of the inner wall 61 and the guiding partition wall 63 of the housing may form a step surface 69 in a partial area, and the cover 70 may include a sealing rib 71 that may be seated on the step surface 69.

As a result, steam may be prevented from leaking between the cover and the housing 10.

The guide nozzle 66 may be stepped at the upper end of the blocking partition wall 64 and extend to a location lower than the step surface 69.

In this regard, the step surface 69 of the blocking partition wall 64 may be spaced apart from the cover 70. In addition, the cover 70 may further include a guide rib 72 that is spaced apart from the step surface 69 of the blocking partition wall but is positioned forward of the step surface 69.

The guide rib 72 may be spaced apart from both the guide nozzle 66 and the step surface 69, and may be positioned such that at least a portion thereof faces an upper end of the guide nozzle 66.

Therefore, steam guided to the blocking partition wall 64 may be first heated while passing through the step surface 69 of the blocking partition wall 64, second heated while passing through the guide rib 72, and third heated while passing through the guide nozzle 66.

Therefore, steam may be prevented from condensing while passing through the blocking partition wall 64.

Water that reaches the blocking partition wall 64 may be heated until it becomes steam at a lower end of the blocking partition wall 64.

The sprayer 15 may be formed at a location that does not face the guide nozzle 66 on the front surface 12 of the housing 10.

The sprayer 15 may be formed at a location where at least a partial area thereof is blocked from overlapping with the guide nozzle 66.

The sprayer 15 may be formed at a location where it is blocked from facing the guide nozzle 66 in the direction from the inlet 14 toward the sprayer 15 and in the direction in which steam flows from the guide nozzle 66 to the spray chamber 50.

The guide nozzle 66 may face the inner wall of the housing 10.

Therefore, at least one of water and steam that has passed through the guide nozzle 66 may be prevented from being sprayed as it is to the sprayer 15. Water and steam that have passed through the guide nozzle 66 may additionally come into contact with the inner wall of the housing 10 and also come into contact with the blocking partition wall 64, and may be continuously heated and discharged to the sprayer 15.

To this end, the sprayer 15 may be disposed at a lower vertical level than the guide nozzle 66. An upper end of the sprayer 15 may be disposed at a lower vertical level than a lower end of the guide nozzle 66.

In one example, the sprayer 15 may be disposed at a lower vertical level than a bottom surface of the heating chamber 40 by a distance equal to or greater than a set spacing d2. As a result, steam may be further accumulated in the housing 10, heated, and discharged to the sprayer 15.

In one example, the spray chamber 50 may further include a collecting portion 53 defined in the bottom surface thereof where water that has not passed through the sprayer 15 is collected.

The collecting portion 53 may be formed such that the bottom surface of the housing 10 corresponding to the spray chamber 50 is recessed more than the sprayer 15. That is, the bottom surface of the housing 10 corresponding to a portion between the front surface 12 and the blocking partition wall 64 may be formed at a lower vertical level than the sprayer 15, and the collecting portion 53 may be formed therein.

The collecting portion 53 may be disposed at a vertical level lower than that of the sprayer 15 by a first depth d1. Accordingly, condensate collected in the collecting portion 53 may be prevented from overflowing into the sprayer 15.

In addition, a bottom surface of the collecting portion 53 may be set lower than the bottom surface of the heating chamber 40 by a collection spacing d1. The collection spacing d1 may be set to be greater than the set spacing d2.

As a result, even when condensate is collected in the collecting portion 53, condensate may be completely reheated without overflowing to the sprayer 15, and may be sprayed as steam to the sprayer 15.

As a result, water and steam introduced into the housing 10 are less likely to condense as they pass through the inner wall of the housing 10, the guiding partition wall 63, the blocking partition wall 64, the guide nozzle 66, the cover 70, and the collecting portion 53, and a temperature of steam may be maintained or further increased.

Therefore, an amount of steam sprayed to the steam iron 1300 may be maintained or continuously secured, condensate may not be generated, and condensate that may be generated may be blocked from being discharged arbitrarily.

Figure 27:
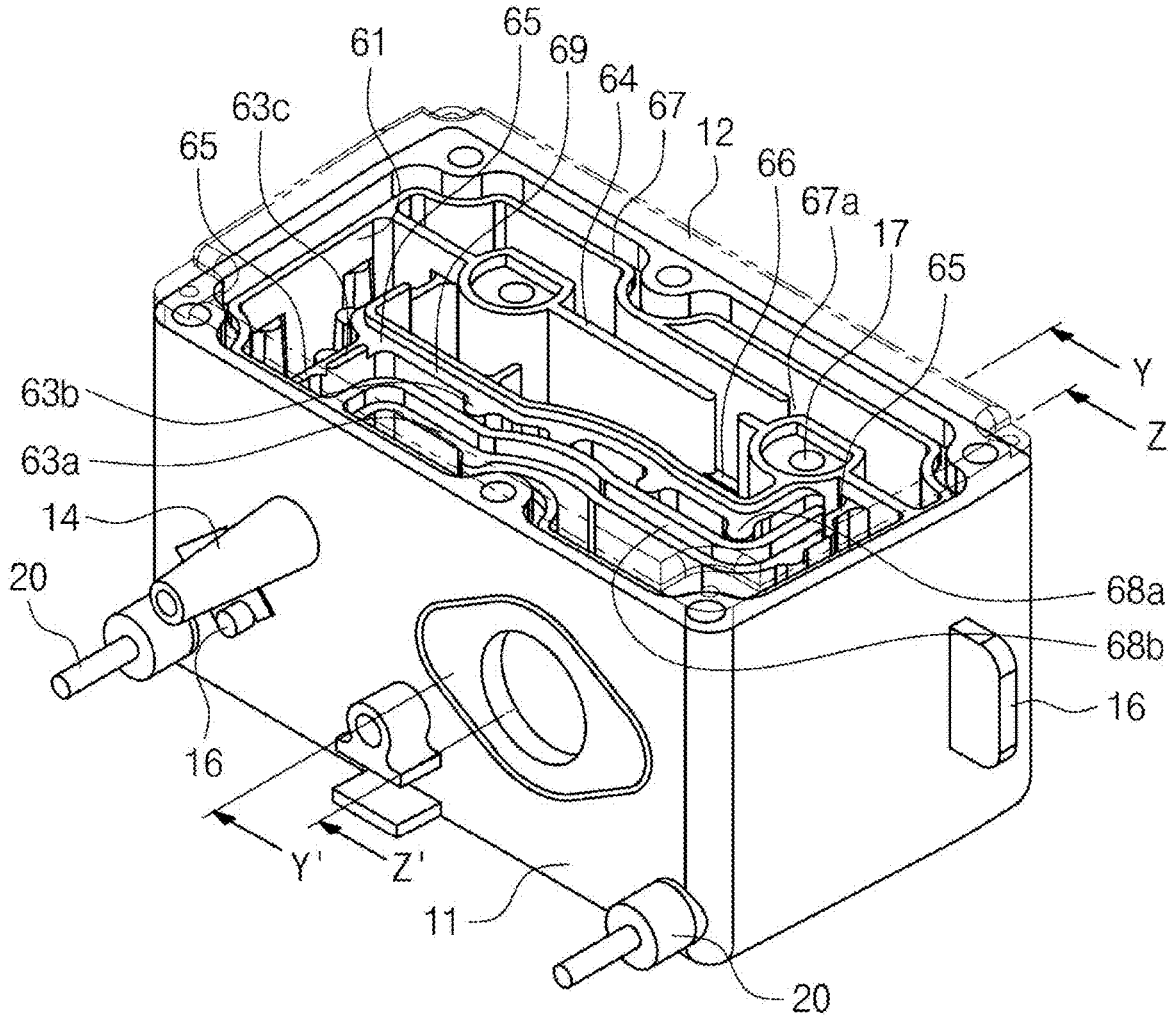
FIG. 27 shows an additional embodiment of the chamber.

FIG. 27 shows an additional embodiment of the chamber.

The chamber portion 1321 may have the sprayer 15 on the front surface of the housing 10, the inlet 14 on the rear surface, and the heating partition wall 60 disposed inside the housing 10 to heat at least one of steam and water introduced from the inlet 14, similar to the embodiment described above.

The heating partition wall 60, as the component that receives energy from the steam heater 20 and reheats water and steam, may include not only the partition wall that partitions the inside of the housing 10, but also the inner wall 61 of the housing 10. The inner wall 61 of the housing 10 may include not only an inner wall of the front surface 12, an inner wall of the side surface 13, and an inner wall of the rear surface 11, but also the bottom surface.

In addition, when the housing 10 has the structure in which the top surface thereof is opened, a bottom surface of the cover 70 may also be regarded as the heating partition wall 60.

The heating partition wall 60 may include the blocking partition wall 64 that divides the storage space or the accommodating space of the housing 10 into the heating chamber 40 in communication with the inlet 14 and the spray chamber 50 in communication with the sprayer 15.

The heating partition wall 60 may include one or more guiding partition walls 63 that divide the heating chamber 40 into a plurality of flow channel areas to increase the cross-sectional area inside the heating chamber 40.

The guiding partition wall 63 may have a structure and a shape different from those in the above-described embodiment, but it is similar in that the area that spans between the inlet 14 and the sprayer 15 or extends to one of both side surfaces of the housing 10 is longer than the area that extends from the inlet 14 toward the sprayer 15.

In addition, the guiding partition wall 63 may have the plurality of protrusions 68 that are spaced apart from each other and are in various shapes.

The protrusion 68 may include a column protrusion 68*a* that protrudes in a curved column shape from the guiding partition wall 63, and a rib protrusion 68*b* that protrudes in a rib shape from the guiding partition wall 63.

An upper end of a peripheral surface of the housing 10 and an upper end of the heating partition wall 60 may be formed with the step surface 69 that is partially stepped. The cover 70 may have the sealing rib 71 that may be engaged with the step surface 69 on the bottom surface thereof. As a result, not only water and steam may be prevented from leaking out of the housing 10, but also water and steam may be prevented from randomly flowing to the upper end of the heating partition wall 60.

The guide nozzle 66 may be defined by cutting a partial area of the blocking partition wall 64 downward. The single guide nozzle 66 may be defined, and may partition the blocking partition wall 64 in an extension direction.

The guide nozzle 66 may be defined in the blocking partition wall 64 to be close to a distal end of the flow channel formed by the guiding partition wall 63. As a result, water and steam may flow as much as possible to the distal end of the flow channel formed by the guiding partition wall 63 and be heated and discharged to the guide nozzle 66.

The guide nozzle 66 may be disposed such that the bottom surface thereof is closer to the lower end than to the upper end of the blocking partition wall 64 based on the open surface. An upper portion of the guide nozzle 66 may be open.

As a result, a phenomenon in which water and steam accumulate in the guide nozzle 66 and hinder steam from flowing to the spray chamber 50 may be prevented.

The lower end of the guide nozzle 66 may be formed at a higher vertical level than the lower end of the blocking partition wall 64 or the bottom surface of the housing 10. As a result, any condensate that may exist may be prevented from being introduced into the spray chamber 50 as it is via the guide nozzle 66.

The heating partition wall 60 may additionally include a separating partition wall 67 that is disposed between the inner wall of the front surface of the housing 10 and the blocking partition wall 64 in the spray chamber 50 and faces the guide nozzle 66. As a result, water and steam that have passed through the guide nozzle 66 may be prevented from being discharged as it is to the sprayer 15.

The separating partition wall 67 may partition the spray chamber 50 in the width direction corresponding to the direction of both side surfaces of the housing 10.

The separating partition wall 67 may be disposed to be spaced apart from the guide nozzle 66 by a certain distance toward the sprayer 15. As a result, the separating partition wall 67 may define an additional collecting portion for collecting condensate together with the blocking partition wall 64.

The separating partition wall 67 is disposed to block the guide nozzle 66 and the sprayer 15 from facing each other or being in direct communication with each other.

The separating partition wall 67 may include a steam guide hole 67*a* defined by recessing or extending through an upper end of the separating partition wall 67 in the front and rear direction.

The steam guide hole 67*a* may be blocked from facing the guide nozzle 66. The steam guide hole 67*a* may be defined such that at least a portion thereof does not overlap the guide nozzle 66.

The steam guide hole 67*a* may be defined at a higher vertical level than the guide nozzle 66, and may be defined to be biased more toward one side than both side surfaces of the guide nozzle 66.

As a result, the steam guide hole 67*a* may allow only steam that has been reheated between the blocking partition wall 64 and the separating partition wall 67, from at least one of water and steam that has passed through the guide nozzle 66, to flow to the sprayer 15.

In one example, when the separating partition wall 67 is additionally disposed, the guide nozzle 66 and the sprayer 15 may be positioned facing each other.

In addition, the sprayer 15 may be positioned at a location that does not overlap the guide nozzle 66 and the steam guide hole 67*a* in the front and rear direction.

Figure 28A:
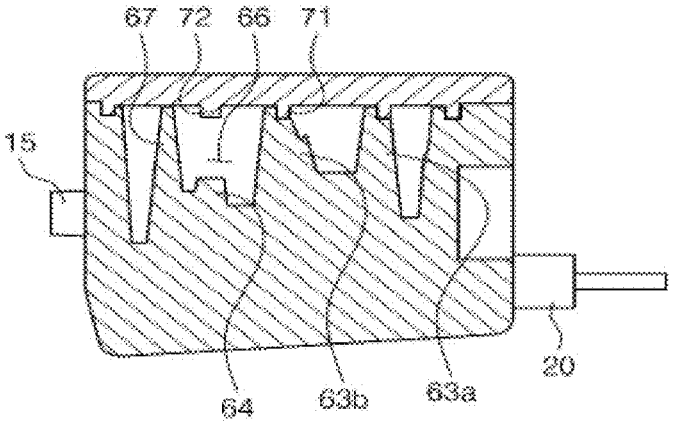
FIGS. 28A and 28B show a cross-section of the chamber.
Figure 28B:
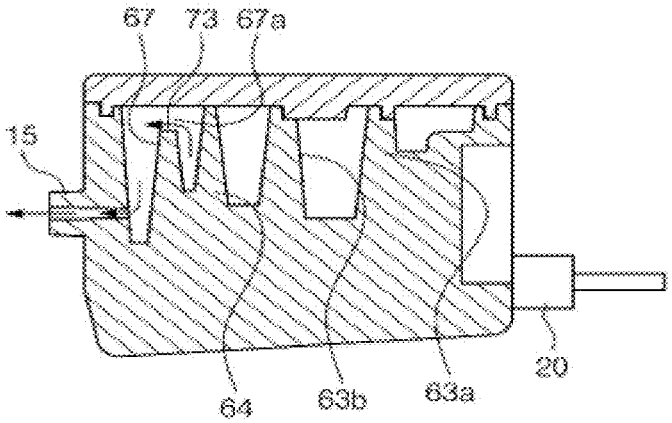

FIGS. 28A and 28B show a cross-section of the chamber.

FIG. 28A shows a cross-section of the chamber portion 1321 in a front and rear direction based on the guide nozzle 66, and FIG. 28B shows a cross-section of the chamber portion 1321 in the front and rear direction based on the steam guide hole 67*a*.

Referring to FIG. 28A, the sprayer 15 may be positioned at a lower vertical level than the lower end of the guide nozzle 66 and a lower end of the steam guide hole 67*a*. As a result, As a result, even when steam has passed through the guide nozzle 66 and the steam guide hole 67*a*, steam should be further heated in the spray chamber 50 to pass through the sprayer 15.

The collecting portion 53 where water is collected may be defined between the sprayer 15 and the separating partition wall 67. The collecting portion 53 may be recessed to a vertical level lower than that of the sprayer 15 to provide a space for collecting condensate.

Condensate collected in the collecting portion 53 may be heated into steam and discharged to the sprayer 15.

In one example, a vertical level of the bottom surface of the flow channel between the guiding partition walls 63 or the bottom surface inner wall of the housing 10 may vary. Therefore, water and steam may be heated while coming into contact not only with the guiding partition wall 63 but also with the bottom surface of the housing 10 in a greater area size.

The guide rib 72 may be inserted into an upper portion of the guide nozzle 66. However, an extension length of the guide rib 72 may be equal to or similar to that of the sealing rib 71.

Referring to FIG. 28B, water and steam that have passed through the guide nozzle 66 may be reheated while passing through the steam guide hole 67*a*, heated again by colliding with the separating partition wall 67, heated while coming into contact with the collecting portion 53, and discharged to the sprayer 15.

Water condensed in such process may be immediately heated into steam inside the housing 10 and discharged to the sprayer 15. In addition, water introduced into the housing 10 or water condensed inside the housing 10 may be all heated into steam in the housing 10 and discharged to the sprayer 15 when the steam heater 20 operates.

Even when the steam heater 20 does not operate, water condensed in the spray chamber 50 and the heating chamber 40 is maintained in the collected state and is maintained in the collected state by the collecting portion 53 and the heating partition wall 60, thereby being blocked from flowing to the sprayer 15. Therefore, water may be blocked from being discharged arbitrarily via the sprayer 15.

The present disclosure may be modified and implemented in various forms, so that the scope of rights thereof is not limited to the above-described embodiments. Therefore, when the modified embodiment includes elements of the claims of the present disclosure, it should be considered to fall within the scope of the present disclosure.

What is claimed is:

1. An ironing module comprising:

a water supply tank configured to store water therein;

a steam generator configured to receive water from the water supply tank and heat water;

a cable configured to transmit at least one of water or steam heated by the steam generator; and a steam iron connected to a distal end of the cable and configured to spray steam to an outside of the steam iron, wherein the steam iron includes a chamber configured to receive water and steam from the cable, reheat the water and the steam, and spray the water and the steam, wherein the chamber includes:

a housing defining a heating space configured to accommodate at least one of water or steam supplied from the cable, a heater coupled to the housing and configured to heat the housing, an inlet connected to the cable, the inlet extending through a first surface of the housing, a sprayer configured to discharge the steam to an outside of the housing, the sprayer extending through a second surface of the housing opposite to the first surface of the housing;

a blocking partition wall dividing inside of the housing into a heating chamber in communication with the inlet and a spray chamber in communication with the sprayer; and a guide nozzle configured to guide at least one of water or steam that has reached the blocking partition wall from the heating chamber to the spray chamber, wherein the guide nozzle is configured to spray, in a direction from the inlet toward the sprayer, the water and the steam toward an inner wall of the second surface of the housing.

2. The ironing module of claim 1, wherein the guide nozzle is disposed such that at least a partial area thereof is blocked from facing the sprayer.

3. The ironing module of claim 2, wherein the chamber further includes a cover coupled to an upper portion of the housing and shielding the heating space, wherein the sprayer is disposed at a vertical level lower than a vertical level of the guide nozzle.

4. The ironing module of claim 3, wherein the chamber further includes a collecting portion positioned at a vertical level lower than the vertical level of the sprayer in the spray chamber to provide a collection space where water is stored and heated.

5. The ironing module of claim 3, wherein the guide nozzle is defined as at least one area of an upper end of the blocking partition wall that is stepped or recessed and spaced apart from the cover.

6. The ironing module of claim 5, wherein the guide nozzle has a lower end positioned closer to the cover than to a lower end of the blocking partition wall.

7. The ironing module of claim 3, wherein the guide nozzle is defined by cutting a partial area of the blocking partition wall or extending through the blocking partition wall.

8. The ironing module of claim 7, wherein a lower end of the guide nozzle is positioned closer to a lower end of the blocking partition wall than to the cover.

9. The ironing module of claim 7, wherein the chamber further includes a separating partition wall disposed in the spray chamber so as to face the guide nozzle.

10. The ironing module of claim 9, wherein the separating partition wall defines a steam guide hole configured to communicate at least one of water or steam that has passed through the guide nozzle to flow toward the sprayer.

11. The ironing module of claim 10, wherein the steam guide hole is defined such that at least a partial area thereof is blocked from facing the guide nozzle.

12. The ironing module of claim 10, wherein the steam guide hole is defined with a width or an area size smaller than a width or an area size of the guide nozzle.

13. The ironing module of claim 10, wherein the chamber further includes a collecting portion positioned at a vertical level lower than the vertical level of the sprayer in the spray chamber to provide a collection space where water is stored and heated, and wherein the collecting portion is positioned between the separating partition wall and the sprayer.

14. The ironing module of claim 1, wherein the chamber further includes at least one guiding partition wall disposed in the heating chamber to form a flow channel to guide water and steam introduced into the inlet to the blocking partition wall, and a protrusion protruding from the guiding partition wall.

15. The ironing module of claim 14, wherein the guiding partition wall has an area spanning between the inlet and the sprayer greater than an area from the inlet toward the sprayer.

* * * * *